US009797414B2

(12) United States Patent
Hodgson et al.

(10) Patent No.: US 9,797,414 B2
(45) Date of Patent: Oct. 24, 2017

(54) FAN ASSEMBLY

(71) Applicant: Dyson Technology Limited, Wiltshire (GB)

(72) Inventors: Christopher Steven Hodgson, Bristol (GB); Darren Matthew Lewis, Sutton (GB); India Shaw Elsdon, Perth (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 266 days.

(21) Appl. No.: 14/324,896

(22) Filed: Jul. 7, 2014

(65) Prior Publication Data

US 2015/0017028 A1 Jan. 15, 2015

(30) Foreign Application Priority Data

Jul. 9, 2013 (GB) ..... 1312331.0

(51) Int. Cl.
*F04F 5/48* (2006.01)
*F04D 25/10* (2006.01)
(Continued)

(52) U.S. Cl.
CPC ..... *F04F 5/48* (2013.01); *F04D 25/105* (2013.01); *F04F 5/16* (2013.01); *F24F 7/007* (2013.01)

(58) Field of Classification Search
CPC ..... F04D 29/403; F04D 25/08; F04D 25/10; F04D 25/105; F04D 27/00; F04D 29/00; F04F 5/48; F04F 5/16; F24F 7/007
See application file for complete search history.

(56) References Cited

U.S. PATENT DOCUMENTS 1,357,261 A 11/1920 Svoboda
1,767,060 A 6/1930 Ferguson
(Continued)

FOREIGN PATENT DOCUMENTS

AU 2008323324 5/2009
AU 2011100923 9/2011
(Continued)

OTHER PUBLICATIONS

International Search Report and Written Opinion dated Jun. 10, 2015, directed to International Application No. PCT/GB2014/051880; 23 pages.
(Continued)

*Primary Examiner* — Charles Freay
*Assistant Examiner* — Thomas Cash
(74) *Attorney, Agent, or Firm* — Morrison & Foerster LLP

(57) ABSTRACT

A fan assembly includes a base, a body including an air inlet, impeller and motor driving the impeller to draw an air flow through the air inlet, an air outlet and an interior passage conveying air to the air outlet and extending about an opening through which air from outside the fan assembly is drawn by air emitted from the air outlet. A motorized oscillation mechanism housed within the base oscillates the body relative to the base about an axis and includes a second motor, a drive member driven by the second motor, and a driven member which is driven by the drive member to rotate relative to the base about the axis. The body is mounted on the driven member for rotation therewith. Interlocking members retain the body on the driven member and serve to guide tilting movement of the body relative to the base about a tilt axis.

40 Claims, 11 Drawing Sheets

(51) Int. Cl.

| | |
|---|---|
| ***F24F 7/00*** | (2006.01) |
| ***F04F 5/16*** | (2006.01) |
| ***F24F 7/007*** | (2006.01) |

(56) References Cited

U.S. PATENT DOCUMENTS

| | | | | |
|---|---|---|---|---|
| 1,896,869 | A | | 2/1933 | Larsh |
| 2,014,185 | A | | 9/1935 | Martin |
| 2,035,733 | A | | 3/1936 | Wall |
| D103,476 | S | | 3/1937 | Weber |
| 2,115,883 | A | | 5/1938 | Sher |
| D115,344 | S | | 6/1939 | Chapman |
| 2,210,458 | A | | 8/1940 | Keilholtz |
| 2,258,961 | A | | 10/1941 | Saathoff |
| 2,336,295 | A | | 12/1943 | Reimuller |
| 2,433,795 | A | | 12/1947 | Stokes |
| 2,473,325 | A | | 6/1949 | Aufiero |
| 2,476,002 | A | | 7/1949 | Stalker |
| 2,488,467 | A | | 11/1949 | De Lisio |
| 2,510,132 | A | | 6/1950 | Morrison |
| 2,544,379 | A | | 3/1951 | Davenport |
| 2,547,448 | A | | 4/1951 | Demuth |
| 2,583,374 | A | | 1/1952 | Hoffman |
| 2,620,127 | A | | 12/1952 | Radcliffe |
| 2,765,977 | A | | 10/1956 | Morrison |
| 2,808,198 | A | | 10/1957 | Morrison |
| 2,813,673 | A | | 11/1957 | Smith |
| 2,830,779 | A | | 4/1958 | Wentling |
| 2,838,229 | A | | 6/1958 | Belanger |
| 2,922,277 | A | | 1/1960 | Bertin |
| 2,922,570 | A | | 1/1960 | Allen |
| 3,004,403 | A | | 10/1961 | Laporte |
| 3,047,208 | A | | 7/1962 | Coanda |
| 3,270,655 | A | | 9/1966 | Guirl et al. |
| D206,973 | S | | 2/1967 | De Lisio |
| 3,444,817 | A | | 5/1969 | Caldwell |
| 3,503,138 | A | | 3/1970 | Fuchs et al. |
| 3,518,776 | A | | 7/1970 | Wolff et al. |
| 3,724,092 | A | | 4/1973 | McCleerey |
| 3,743,186 | A | | 7/1973 | Mocarski |
| 3,795,367 | A | | 3/1974 | Mocarski |
| 3,872,916 | A | | 3/1975 | Beck |
| 3,875,745 | A | | 4/1975 | Franklin |
| 3,885,891 | A | | 5/1975 | Throndson |
| 3,943,329 | A | | 3/1976 | Hlavac |
| 4,037,991 | A | | 7/1977 | Taylor |
| 4,046,492 | A | | 9/1977 | Inglis |
| 4,061,188 | A | | 12/1977 | Beck |
| 4,073,613 | A | | 2/1978 | Desty |
| 4,113,416 | A | | 9/1978 | Kataoka et al. |
| 4,136,735 | A | | 1/1979 | Beck et al. |
| 4,173,995 | A | | 11/1979 | Beck |
| 4,180,130 | A | | 12/1979 | Beck et al. |
| 4,184,541 | A | | 1/1980 | Beck et al. |
| 4,192,461 | A | | 3/1980 | Arborg |
| 4,332,529 | A | | 6/1982 | Alperin |
| 4,336,017 | A | | 6/1982 | Desty |
| 4,342,204 | A | | 8/1982 | Melikian et al. |
| 4,448,354 | A | | 5/1984 | Reznick et al. |
| 4,502,837 | A | | 3/1985 | Blair et al. |
| 4,568,243 | A | | 2/1986 | Schubert et al. |
| 4,630,475 | A | | 12/1986 | Mizoguchi |
| 4,643,351 | A | | 2/1987 | Fukamachi et al. |
| 4,703,152 | A | * | 10/1987 | Shih-Chin ..... F24H 3/0417 318/282 |
| 4,718,870 | A | | 1/1988 | Watts |
| 4,732,539 | A | | 3/1988 | Shin-Chin |
| 4,790,133 | A | | 12/1988 | Stuart |
| 4,850,804 | A | | 7/1989 | Huang |
| 4,878,620 | A | | 11/1989 | Tarleton |
| 4,893,990 | A | | 1/1990 | Tomohiro et al. |
| 4,978,281 | A | | 12/1990 | Conger |
| 5,061,405 | A | | 10/1991 | Stanek et al. |
| D325,435 | S | | 4/1992 | Coup et al. |
| 5,168,722 | A | | 12/1992 | Brock |
| 5,176,856 | A | | 1/1993 | Takahashi et al. |
| 5,188,508 | A | | 2/1993 | Scott et al. |
| 5,296,769 | A | | 3/1994 | Havens et al. |
| 5,310,313 | A | | 5/1994 | Chen |
| 5,317,815 | A | | 6/1994 | Hwang |
| 5,395,087 | A | | 3/1995 | VanBasten |
| 5,402,938 | A | | 4/1995 | Sweeney |
| 5,407,324 | A | | 4/1995 | Starnes, Jr. et al. |
| 5,411,371 | A | | 5/1995 | Chen |
| 5,425,902 | A | | 6/1995 | Miller et al. |
| 5,518,370 | A | | 5/1996 | Wang et al. |
| 5,609,473 | A | | 3/1997 | Litvin |
| 5,645,769 | A | | 7/1997 | Tamaru et al. |
| 5,649,370 | A | | 7/1997 | Russo |
| 5,720,594 | A | | 2/1998 | Snow |
| 5,730,582 | A | | 3/1998 | Heitmann |
| 5,735,683 | A | | 4/1998 | Muschelknautz |
| 5,762,034 | A | | 6/1998 | Foss |
| 5,762,661 | A | | 6/1998 | Kleinberger et al. |
| 5,783,117 | A | | 7/1998 | Byassee et al. |
| D398,983 | S | | 9/1998 | Keller et al. |
| 5,841,080 | A | | 11/1998 | Iida et al. |
| 5,843,344 | A | | 12/1998 | Junkel et al. |
| 5,862,037 | A | | 1/1999 | Behl |
| 5,868,197 | A | | 2/1999 | Potier |
| 5,881,685 | A | | 3/1999 | Foss et al. |
| D415,271 | S | | 10/1999 | Feer |
| 6,007,038 | A | * | 12/1999 | Han ..... F16M 11/10 248/346.06 |
| 6,015,274 | A | | 1/2000 | Bias et al. |
| 6,065,936 | A | | 5/2000 | Shingai et al. |
| 6,073,881 | A | | 6/2000 | Chen |
| 6,082,969 | A | | 7/2000 | Carroll et al. |
| D429,808 | S | | 8/2000 | Krauss et al. |
| 6,123,618 | A | | 9/2000 | Day |
| 6,155,782 | A | | 12/2000 | Hsu |
| 6,163,451 | A | * | 12/2000 | Chiu ..... F16M 11/10 248/419 |
| D435,899 | S | | 1/2001 | Melwani |
| 6,244,823 | B1 | | 6/2001 | Marino et al. |
| 6,254,337 | B1 | | 7/2001 | Arnold |
| 6,269,549 | B1 | | 8/2001 | Carlucci et al. |
| 6,278,248 | B1 | | 8/2001 | Hong et al. |
| 6,282,746 | B1 | | 9/2001 | Schleeter |
| 6,293,121 | B1 | | 9/2001 | Labrador |
| 6,321,034 | B2 | | 11/2001 | Jones-Lawlor et al. |
| 6,338,610 | B1 | | 1/2002 | Harada et al. |
| 6,348,106 | B1 | | 2/2002 | Embree et al. |
| 6,386,845 | B1 | | 5/2002 | Bedard |
| 6,454,527 | B2 | | 9/2002 | Nishiyama et al. |
| 6,480,672 | B1 | | 11/2002 | Rosenzweig et al. |
| 6,511,288 | B1 | | 1/2003 | Gatley, Jr. |
| 6,599,088 | B2 | | 7/2003 | Stagg |
| D485,895 | S | | 1/2004 | Melwani |
| 6,709,236 | B1 | | 3/2004 | Hoelzer |
| 6,789,787 | B2 | | 9/2004 | Stutts |
| 6,830,433 | B2 | | 12/2004 | Birdsell et al. |
| 6,932,579 | B2 | | 8/2005 | Cichetti, Sr. et al. |
| 7,059,826 | B2 | | 6/2006 | Lasko |
| 7,088,913 | B1 | | 8/2006 | Verhoorn et al. |
| 7,147,336 | B1 | | 12/2006 | Chou |
| D539,414 | S | | 3/2007 | Russak et al. |
| 7,186,075 | B2 | | 3/2007 | Winkler et al. |
| 7,189,053 | B2 | | 3/2007 | Winkler et al. |
| 7,317,267 | B2 | | 1/2008 | Schmid et al. |
| 7,455,504 | B2 | | 11/2008 | Hill et al. |
| 7,478,993 | B2 | | 1/2009 | Hong et al. |
| 7,540,474 | B1 | | 6/2009 | Huang et al. |
| D598,532 | S | | 8/2009 | Dyson et al. |
| D602,143 | S | | 10/2009 | Gammack et al. |
| D602,144 | S | | 10/2009 | Dyson et al. |
| D605,748 | S | | 12/2009 | Gammack et al. |
| 7,664,377 | B2 | | 2/2010 | Liao |
| D614,280 | S | | 4/2010 | Dyson et al. |
| 7,775,848 | B1 | | 8/2010 | Auerbach |
| 7,806,388 | B2 | | 10/2010 | Junkel et al. |
| 7,921,962 | B2 | | 4/2011 | Liddell |
| 8,092,166 | B2 | | 1/2012 | Nicolas et al. |
| 8,430,624 | B2 | | 4/2013 | Cookson et al. |

(56) References Cited

U.S. PATENT DOCUMENTS

| | | | |
|---|---|---|---|
| 8,469,658 | B2 | 6/2013 | Gammack et al. |
| 2002/0106547 | A1 | 8/2002 | Sugawara et al. |
| 2003/0059307 | A1 | 3/2003 | Moreno et al. |
| 2003/0171093 | A1 | 9/2003 | Gumucio Del Pozo |
| 2004/0022631 | A1 | 2/2004 | Birdsell et al. |
| 2004/0049842 | A1 | 3/2004 | Prehodka |
| 2004/0149881 | A1 | 8/2004 | Allen |
| 2005/0031448 | A1 | 2/2005 | Lasko et al. |
| 2005/0053465 | A1 | 3/2005 | Roach et al. |
| 2005/0069407 | A1 | 3/2005 | Winkler et al. |
| 2005/0128698 | A1 | 6/2005 | Huang |
| 2005/0163670 | A1 | 7/2005 | Alleyne et al. |
| 2005/0173997 | A1 | 8/2005 | Schmid et al. |
| 2005/0276684 | A1 | 12/2005 | Huang et al. |
| 2005/0281672 | A1 | 12/2005 | Parker et al. |
| 2006/0172682 | A1 | 8/2006 | Orr et al. |
| 2006/0199515 | A1 | 9/2006 | Lasko et al. |
| 2007/0035189 | A1 | 2/2007 | Matsumoto |
| 2007/0041857 | A1 | 2/2007 | Fleig |
| 2007/0048159 | A1 | 3/2007 | DiMatteo et al. |
| 2007/0065280 | A1 | 3/2007 | Fok |
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0269323 | A1 | 11/2007 | Zhou et al. |
| 2008/0020698 | A1 | 1/2008 | Spaggiari |
| 2008/0152482 | A1 | 6/2008 | Patel |
| 2008/0166224 | A1 | 7/2008 | Giffin |
| 2008/0286130 | A1 | 11/2008 | Purvines |
| 2008/0304986 | A1 | 12/2008 | Kenyon et al. |
| 2008/0314250 | A1 | 12/2008 | Cowie et al. |
| 2009/0026850 | A1 | 1/2009 | Fu |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0191054 | A1 | 7/2009 | Winkler |
| 2009/0214341 | A1 | 8/2009 | Craig |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1* | 9/2010 | Gammack ..... F04D 25/08 415/182.1 |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0002775 | A1 | 1/2011 | Ma et al. |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0114513 | A1 | 5/2012 | Simmonds et al. |
| 2012/0230658 | A1 | 9/2012 | Fitton et al. |
| 2013/0011252 | A1 | 1/2013 | Crawford et al. |
| 2013/0017104 | A1 | 1/2013 | Stewart et al. |
| 2013/0045084 | A1 | 2/2013 | Tu et al. |
| 2013/0189083 | A1 | 7/2013 | Atkinson |
| 2013/0302156 | A1 | 11/2013 | Nurzynski |
| 2013/0309065 | A1 | 11/2013 | Johnson et al. |
| 2013/0309066 | A1 | 11/2013 | Atkinson et al. |
| 2013/0309080 | A1 | 11/2013 | Johnson et al. |
| 2013/0323025 | A1 | 12/2013 | Crawford et al. |
| 2014/0017069 | A1 | 1/2014 | Peters |

FOREIGN PATENT DOCUMENTS

| | | |
|---|---|---|
| BE | 560119 | 8/1957 |
| CA | 1055344 | 5/1979 |
| CA | 2155482 | 9/1996 |
| CH | 346643 | 5/1960 |
| CN | 87 2 02488 | 3/1988 |
| CN | 2085866 | 10/1991 |
| CN | 21 11392 | 7/1992 |
| CN | 2228996 | 6/1996 |
| CN | 1232143 | 10/1999 |
| CN | 1288506 | 3/2001 |
| CN | 1336482 | 2/2002 |
| CN | 1437300 | 8/2003 |
| CN | 2650005 | 10/2004 |
| CN | 2713643 | 7/2005 |
| CN | 1680727 | 10/2005 |
| CN | 2806846 | 8/2006 |
| CN | 2833197 | 11/2006 |
| CN | 101046318 | 10/2007 |
| CN | 200966872 | 10/2007 |
| CN | 201180678 | 1/2009 |
| CN | 201221477 | 4/2009 |
| CN | 201281416 | 7/2009 |
| CN | 101560988 | 10/2009 |
| CN | 201349269 | 11/2009 |
| CN | 101749288 | 6/2010 |
| CN | 201502549 | 6/2010 |
| CN | 101816534 | 9/2010 |
| CN | 101825095 | 9/2010 |
| CN | 101825102 | 9/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102305220 | 1/2012 |
| CN | 102367813 | 3/2012 |
| CN | 202165330 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 41 27 134 | 2/1993 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| DE | 10 2009 044 349 | 5/2011 |
| EP | 0 044 494 | 1/1982 |
| EP | 0 186 581 | 7/1986 |
| EP | 0 837 245 | 4/1998 |
| EP | 0 955 469 | 11/1999 |
| EP | 1 094 224 | 4/2001 |
| EP | 1 138 954 | 10/2001 |
| EP | 1 566 548 | 8/2005 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |

(56) References Cited

FOREIGN PATENT DOCUMENTS

| | | |
|---|---|---|
| FR | 1119439 | 6/1956 |
| FR | 1.387.334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 237 323 | 5/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468318 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-1015 | 1/1978 |
| JP | 53-51608 | 5/1978 |
| JP | 53-60100 | 5/1978 |
| JP | 56-167897 | 12/1981 |
| JP | 57-71000 | 5/1982 |
| JP | 57-157097 | 9/1982 |
| JP | 59-90797 | 5/1984 |
| JP | 59-167984 | 11/1984 |
| JP | 60-105896 | 7/1985 |
| JP | 61-31830 | 2/1986 |
| JP | 61-116093 | 6/1986 |
| JP | 61-218824 | 9/1986 |
| JP | 61-280787 | 12/1986 |
| JP | 62-223494 | 10/1987 |
| JP | 63-179198 | 7/1988 |
| JP | 63-306340 | 12/1988 |
| JP | 64-7273 | 2/1989 |
| JP | 64-21300 | 2/1989 |
| JP | 64-83884 | 3/1989 |
| JP | 1-138399 | 5/1989 |
| JP | 1-224496 | 9/1989 |
| JP | 1-224598 | 9/1989 |
| JP | 2-146294 | 6/1990 |
| JP | 2-218890 | 8/1990 |
| JP | 2-248690 | 10/1990 |
| JP | 3-3419 | 1/1991 |
| JP | 3-52515 | 5/1991 |
| JP | 3-267598 | 11/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 7-247991 | 9/1995 |
| JP | 8-21400 | 1/1996 |
| JP | 9-100800 | 4/1997 |
| JP | 2619548 | 6/1997 |
| JP | 9-287600 | 11/1997 |
| JP | 10-65999 | 3/1998 |
| JP | 10-122188 | 5/1998 |
| JP | 11-227866 | 8/1999 |
| JP | 2000-116179 | 4/2000 |
| JP | 2000-201723 | 7/2000 |
| JP | 2001-17358 | 1/2001 |
| JP | 2001-295785 | 10/2001 |
| JP | 2002-21797 | 1/2002 |
| JP | 2002-138829 | 5/2002 |
| JP | 2002-188593 | 7/2002 |
| JP | 2002-213388 | 7/2002 |
| JP | 2003-274070 | 9/2003 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-138763 | 6/2007 |
| JP | 2007-138789 | 6/2007 |
| JP | 2008-39316 | 2/2008 |
| JP | 2008-100204 | 5/2008 |
| JP | 3146538 | 10/2008 |
| JP | 2008-294243 | 12/2008 |
| JP | 2009-44568 | 2/2009 |
| JP | 2009-264121 | 11/2009 |
| JP | 2010-131259 | 6/2010 |
| JP | 2010-203446 | 9/2010 |
| JP | 2010-203450 | 9/2010 |
| JP | 2012-36897 | 2/2012 |
| JP | 2012-57619 | 3/2012 |
| KR | 2002-0061691 | 7/2002 |
| KR | 2002-0067468 | 8/2002 |
| KR | 10-2005-0102317 | 10/2005 |
| KR | 10-0576107 | 4/2006 |
| KR | 2007-0007997 | 1/2007 |
| KR | 10-2010-0055611 | 5/2010 |
| KR | 2000-0032363 | 6/2010 |
| KR | 10-0985378 | 9/2010 |
| TW | 412138 | 11/2000 |
| TW | M394383 | 12/2010 |
| TW | M407299 | 7/2011 |
| WO | WO-90/13478 | 11/1990 |
| WO | WO-02/073096 | 9/2002 |
| WO | WO-03/058795 | 7/2003 |

(56) References Cited

FOREIGN PATENT DOCUMENTS

| | | |
|---|---|---|
| WO | WO-03/069931 | 8/2003 |
| WO | WO-2005/050026 | 6/2005 |
| WO | WO-2005/057091 | 6/2005 |
| WO | WO-2006/008021 | 1/2006 |
| WO | WO-2006/012526 | 2/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2009/030879 | 3/2009 |
| WO | WO-2009/030881 | 3/2009 |
| WO | WO-2010/100448 | 9/2010 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |
| WO | WO-2011/055134 | 5/2011 |
| WO | WO-2012/052736 | 4/2012 |

OTHER PUBLICATIONS

Combined Search and Examination Report dated Oct. 20, 2015, directed to GB Application No. 1515915.5; 3 pages.
Search Report dated Feb. 27, 2014, directed to GB Application No. 1312331.0; 1 page.
Reba, I. (1966). "Applications of the Coanda Effect," *Scientific American* 214:84-92.
Third Party Submission Under 37 CFR 1.99 filed Jun. 2, 2011, directed to U.S. Appl. No. 12/203,698; 3 pages.
Gammack et al., U.S. Office Action dated Dec. 9, 2010, directed to U.S. Appl. No. 12/203,698; 10 pages.
Gammack et al., U.S. Office Action dated Jun. 21, 2011, directed to U.S. Appl. No. 12/203,698; 11 pages.
Gammack et al., U.S. Office Action dated Sep. 17, 2012, directed to U.S. Appl. No. 13/114,707; 12 pages.
Gammack et al., U.S. Office Action dated Dec. 10, 2010, directed to U.S. Appl. No. 12/230,613; 12 pages.
Gammack et al., U.S. Office Action dated May 13, 2011, directed to U.S. Appl. No. 12/230,613; 13 pages.
Gammack et al., U.S. Office Action dated Sep. 7, 2011, directed to U.S. Appl. No. 12/230,613; 15 pages.
Gammack et al., U.S. Office Action dated Jun. 8, 2012, directed to U.S. Appl. No. 12/230,613; 15 pages.
Gammack et al., U.S. Office Action dated Aug. 20, 2012, directed to U.S. Appl. No. 12/945,558; 15 pages.
Fitton et al., U.S. Office Action dated Nov. 30, 2010 directed to U.S. Appl. No. 12/560,232; 9 pages.
Nicolas et al., U.S. Office Action dated Mar. 7, 2011, directed to U.S. Appl. No. 12/622,844; 10 pages.
Nicolas et al., U.S. Office Action dated Sep. 8, 2011, directed to U.S. Appl. No. 12/622,844; 11 pages.
Gammack et al., U.S. Office Action dated Dec. 9, 2010, directed to U.S. Appl. No. 12/716,781; 17 pages.
Gammack et al., U.S. Office Action dated Jun. 24, 2011, directed to U.S. Appl. No. 12/716,781; 19 pages.
Fitton et al., U.S. Office Action dated Mar. 30, 2012, directed to U.S. Appl. No. 12/716,707; 7 pages.
Gammack et al., U.S. Office Action dated Nov. 29, 2012, directed to U.S. Appl. No. 12/716,742; 9 pages.
Cookson et al., U.S. Office Action dated Dec. 19, 2012, directed to U.S. Appl. No. 12/716,778; 8 pages.
Hodgson et al., U.S. Office Action dated Mar. 24, 2014, directed to U.S. Appl. No. 13/207,212; 10 pages.
Gammack et al., U.S. Office Action dated Apr. 12, 2011, directed to U.S. Appl. No. 12/716,749; 8 pages.
Gammack et al., U.S. Office Action dated Sep. 1, 2011, directed to U.S. Appl. No. 12/716,749; 9 pages.
Gammack et al., U.S. Office Action dated Jun. 25, 2012, directed to U.S. Appl. No. 12/716,749; 11 pages.
Gammack et al., U.S. Office Action dated Jan. 7, 2013, directed to U.S. Appl. No. 12/716,749; 16 pages.
Gammack et al. U.S. Office Action dated Nov. 2, 2012, directed to U.S. Appl. No. 13/314,974; 8 pages.
Gammack, et al., Office Action dated Jun. 6, 2013, directed to U.S. Appl. No. 13/314,974; 7 pages.
Gammack et al., U.S. Office Action dated Jun. 9, 2014, directed to U.S. Appl. No. 13/314,974; 9 pages.
Gammack et al., U.S. Office Action dated May 24, 2011, directed to U.S. Appl. No. 12/716,613; 9 pages.
Gammack et al., U.S. Office Action dated Nov. 2, 2012, directed to U.S. Appl. No. 13/284,516; 9 pages.
Fitton et al., U.S. Office Action dated Mar. 8, 2011, directed to U.S. Appl. No. 12/716,780; 12 pages.
Fitton et al., U.S. Office Action dated Sep. 6, 2011, directed to U.S. Appl. No. 12/716,780; 16 pages.

* cited by examiner

FAN ASSEMBLY

REFERENCE TO RELATED APPLICATIONS

This application claims the priority of United Kingdom Application No. 1312331.0, filed Jul. 9, 2013, the entire contents of which are incorporated herein by reference.

FIELD OF THE INVENTION

The present invention relates to a fan assembly and a stand for a fan assembly.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation.

Some fans, such as that described in U.S. Pat. No. 5,609,473, provide a user with an option to adjust the direction in which air is emitted from the fan. In U.S. Pat. No. 5,609,473, the fan comprises a base and a pair of yokes each upstanding from a respective end of the base. The outer body of the fan houses a motor and a set of rotating blades. The outer body is secured to the yokes so as to be pivotable relative to the base. The fan body may be swung relative to the base from a generally vertical, untilted position to an inclined, tilted position. In this way the direction of the air flow emitted from the fan can be altered.

WO 2010/100451 describes a fan assembly which does not use caged blades to project air from the fan assembly. Instead, the fan assembly comprises a cylindrical stand which houses a motor-driven impeller for drawing a primary air flow into the stand, and an annular nozzle connected to the stand and comprising an annular air outlet through which the primary air flow is emitted from the fan. The nozzle defines a central opening through which air in the local environment of the fan assembly is drawn by the primary air flow emitted from the air outlet, amplifying the primary air flow.

The stand comprises a base and a body mounted on the base. The body houses the motor-driven impeller. The body is secured to the base so that that body can be moved relative to the base from an untilted position to a tilted position by pushing or sliding the body relative to the base. The base is divided into an upper base member and a lower base member. The body is mounted on the upper base member. The base includes an oscillating mechanism for oscillating the upper base member and the body relative to the lower base member. The upper base member has a concave upper surface upon which are mounted a plurality of L-shaped rails for retaining the body on the base, and for guiding the sliding movement of the body relative to the base as it is moved to or from a tilted position. The body has a convex lower surface upon which a convex tilt plate is mounted. The tilt plate comprises a plurality of L-shaped runners which interlock with the rails on the upper base member as the tilt plate is secured to the base so that flanges of the runners are located beneath conformingly shaped flanges of the rails.

The stand thus comprises three external components: the body, the upper base member and the lower base member. The upper base member comprises a control panel, which includes a plurality of user-operable buttons, and a dial for controlling operations of the fan assembly, such as the actuation and the rotational speed of the motor, and the actuation of the oscillating mechanism. When the oscillation mechanism is operating, the upper base member oscillates with the body relative to the lower base member and so the user is required to interact with a moving control panel to control the operations of the fan assembly.

SUMMARY OF THE INVENTION

In a first aspect, the present invention provides a fan assembly comprising a base, a body comprising at least one air inlet, an impeller, and a first motor for driving the impeller to draw an air flow through said at least one air inlet at least one air outlet an interior passage for conveying air to said at least one air outlet, the interior passage extending about a bore through which air from outside the fan assembly is drawn by air emitted from said at least one air outlet a motorized oscillation mechanism housed within the base for oscillating the body relative to the base about an oscillation axis, the oscillation mechanism comprising a second motor, a drive member driven by the second motor, and a driven member which is driven by the drive member to rotate relative to the base about the oscillation axis, wherein the body is mounted on the driven member for rotation therewith and interlocking members for retaining the body on the driven member, the interlocking members being arranged to guide tilting movement of the body relative to the base about a tilt axis, different from the oscillation axis, between a untilted position and a tilted position.

The present invention thus replaces the upper and lower base members of the base of the fan assembly of WO 2010/100451 with a base relative to which the body can be both oscillated and tilted. In addition to reducing the number of components of the base, the base may then be provided with a user interface for allowing a user to control the fan assembly. This user interface may then remain in a fixed position relative to a user of the fan irrespective of the position of the body relative to the base.

The motorized oscillation mechanism comprises a second motor, a drive member driven by the motor, and a driven member which is driven by the drive member to rotate about the oscillation axis. The second motor is connected to the base so that the second motor remains in a fixed position relative to the base. The second motor is preferably a stepper motor. The driven member is mounted on the base for rotation relative thereto. Bearings are provided within the base for supporting the driven member for rotation relative to the base. The drive member is preferably arranged to engage a peripheral portion of the driven member to rotate the driven member about the oscillation axis. The drive member and the driven member are preferably in the form of gears. The drive member is preferably a spur gear connected to a drive shaft of the second motor. The drive shaft of the second motor preferably extends in a direction which is parallel to the oscillation axis. The driven member is preferably also in the form of a spur gear, having a set of teeth located on the peripheral portion of the driven member which mesh with teeth provided on the drive member. Instead of spur gears, other gear types may be used, such as helical gears, spur gears, worm gears, rack and pinion gears, and magnetic gears.

The direction and speed of rotation of the second motor is preferably controlled by a control circuit. The control circuit is preferably housed within the base. In a preferred embodiment, the fan assembly comprises a remote control for transmitting control signals to the user interface in response to a user depressing one or more buttons of the remote control. The user interface preferably comprises a user interface circuit having a receiver for receiving the control signals transmitted by the remote control. The user interface circuit supplies the received control signals to the control circuit. This can allow the user to actuate the oscillation mechanism using the remote control. To allow the user to operate the fan assembly without using the remote control, the user interface may also comprise an actuator, for example a push button actuator, mounted on the base for actuating a switch of the user interface circuit through movement of the actuator towards the switch. The actuator may be arranged to convey control signals received from the remote control to the receiver, and so may perform the dual function of actuating the switch, preferably in response to a user pushing the actuator towards the switch, and transferring to the receiver control signals which have been transmitted by the remote control and which are incident upon the actuator. This dual function of the actuator can allow the appliance to be provided without a dedicated window or other dedicated light transmissive component for conveying the signals transmitted by the remote control to the receiver, thereby reducing manufacturing costs.

As mentioned above, the actuator is preferably a push button actuator which may be pressed by the user to contact the switch to change an operational mode, state or setting of the fan assembly. For example, in response to the user pressing the actuator the control circuit may be arranged to actuate the first motor for driving the impeller. Alternatively, the actuator may be in the form of a slidable actuator, a rotatable actuator or dial. An advantage of providing the actuator in the form of a push button actuator is that a light path for conveying the light signals to the receiver can be maintained irrespective of the current position of the actuator relative to the switch.

The control circuit may be arranged to drive the second motor at a set speed in both forwards and reverse directions, or at a variable speed in both forwards and reverse directions. The control circuit may be programmed to vary the speed of the second motor in a predefined manner during an oscillation cycle. For example, the speed of the second motor may vary in a sinusoidal manner during an oscillation cycle. Alternatively, or additionally, the speed of the second motor may be varied using the remote control. During each oscillation cycle, the body may be rotated about the oscillation axis by an angle in the range from 0 to 360°, preferably by an angle in the range from 60 to 240°. The control circuit may be arranged to store a plurality of predefined oscillation patterns, and the user may select one of these patterns using the remote control. These oscillation patterns may have different oscillation angles, such as 90°, 120° and 180°.

The body is mounted on the driven member for rotation therewith and relative to the base. Interlocking members are provided for retaining the body on the driven member. The body is preferably mounted directly on the driven member, and so in a preferred embodiment the interlocking members comprise a first interlocking member located on the driven member and a second interlocking member located on the body and which is retained by the first interlocking member. Alternatively, one or more connectors and/or connecting members may be provided between the body and the driven member for attaching the body to the driven member, and so at least one of the interlocking members may be provided on such a connecting member.

The body preferably comprises a plate connected to an outer casing of the body. The second interlocking member preferably forms part of this plate. The plate is preferably connected to the outer casing so that the outer casing surrounds at least the outer periphery of the plate.

The fan assembly preferably comprises a plurality of pairs of these interlocking members for retaining the body on the driven member. Each pair of interlocking members preferably comprises a first interlocking member located on the driven member and a second interlocking member located on the body and which is retained by the first interlocking member. Each of the interlocking members preferably comprises a curved flange which extends in the direction of tilting movement of the body relative to the base. The flanges of each pair of interlocking members preferably have substantially the same curvature. During assembly, the flange of the second interlocking member is slid beneath the flange of the first interlocking member so that the flange of the first interlocking member prevents the body from being lifted from the driven member, and thus from the base. Where the body comprises a plate, the second interlocking members are preferably connected to or otherwise form part of that plate. During assembly, the flanges of the second interlocking members are slid beneath the flanges of the first interlocking members before the plate is secured to the outer casing of the body.

The body may be manually slidable relative to the base between the untilted position and the tilted position. This can enable the body to be easily moved relative to the base, for example by either pushing or pulling the body relative to the base, between the tilted and untilted positions. While manually moving the body relative to the base is relatively straightforward when the body is stationary relative to the base, it can be awkward for the user to tilt the body relative to the base while the body is oscillating relative to the base, and so in a preferred embodiment the fan assembly comprises a motorized drive mechanism for actuating movement of the body relative to the base about the tilt axis. Preferably, the drive mechanism comprises a third motor, and a second drive member driven by the third motor. The third motor is preferably also in the form of a stepper motor. The second drive member is preferably in the form of a gear, and is preferably a spur gear connected to a shaft of the third motor.

The direction and speed of rotation of the third motor is preferably controlled by the control circuit. The control circuit may be arranged to rotate the third motor at a set speed in both forwards and reverse directions to move the body between an untilted position, or a first tilted position, relative to the base and a second tilted position relative to the base. The body may be moved about the tilt axis by an angle in the range from −20 to 20°, preferably by an angle in the range from −10 to 10°. The actuation of the third motor may be controlled by the user through depressing an appropriate button on the remote control.

The control circuit may be arranged to operate the second motor and the third motor simultaneously to promote the distribution of the airflow generated by the fan assembly around a room or other domestic environment. This operational mode of the fan assembly may be actuated by a user through pressing a dedicated one of the buttons of the remote control. The control circuit may be arranged to store a plurality of predefined patterns of movement of the body relative to the base, and the user may select one of these patterns using the user interface or the remote control of the fan assembly.

The third motor is preferably connected to the body for movement therewith as the body moves about the tilt axis. The third motor is preferably mounted on the tilt plate. Where the second interlocking member(s) are connected to a surface of the tilt plate which faces the base, the third motor is preferably connected to an opposite side of the tilt plate. The second drive member preferably engages the driven member of the oscillation mechanism in such a manner that the motor and the drive member of the drive mechanism move relative to the driven member about the tilt axis upon actuation of the drive mechanism. The driven member comprises a set of teeth for engaging with teeth of the second drive member, and this set of teeth is preferably located on a central portion of the driven member. This set of teeth preferably extends about the tilt axis. The tilt axis is preferably substantially orthogonal to the oscillation axis.

In a preferred embodiment the outer surfaces of the base and the body have substantially the same profile. For example, the profile of the outer surfaces of the base and the body may be substantially circular, elliptical, or polyhedral.

The interlocking members are preferably enclosed by the outer surfaces of the base and the body when the body is in the untilted position. This can enable the fan assembly to have a tidy and uniform appearance, and can inhibit the ingress of dust and dirt between the interlocking members.

The interior passage and the at least one air outlet of the fan assembly are preferably defined by a nozzle mounted on or connected to the body. The base and the body thus may together provide a stand upon which the nozzle is mounted. The at least one air outlet may be located at or towards the front end of the nozzle. Alternatively, the at least one air outlet may be located towards the rear end of the nozzle. The nozzle may comprise a single air outlet or a plurality of air outlets. In one example, the nozzle comprises a single, annular air outlet extending about the bore, and this air outlet may be circular in shape, or otherwise have a shape which matches the shape of the front end of the nozzle. The interior passage preferably comprises a first section and a second section each for receiving a respective portion of an air flow entering the interior passage, and for conveying the portions of the air flow in opposite angular directions about the bore. Each section of the interior passage may comprise a respective air outlet. The nozzle is preferably substantially symmetrical about a plane passing through the centre of the nozzle. For example, the nozzle may have a generally circular, elliptical or "race-track" shape, in which each section of the interior passage comprises a relatively straight section located on a respective side of the bore. Where the nozzle has a race track shape each straight section of the nozzle may comprise a respective air outlet. The, or each, air outlet is preferably in the form of a slot. The slot preferably has a width in the range from 0.5 to 5 mm.

In a second aspect the present invention provides a stand for a fan assembly, the stand comprising a base, a body comprising at least one air inlet, an impeller, a motor for driving the impeller to draw an air flow through said at least one air inlet, and an air outlet, a motorized oscillation mechanism housed within the base for oscillating the body relative to the base about an oscillation axis, the oscillation mechanism comprising a motor, a drive member driven by the motor, and a driven member which is driven by the drive member to rotate relative to the base about the oscillation axis, wherein the body is mounted on the driven member for rotation therewith, and interlocking members for retaining the body on the driven member, and wherein the interlocking members comprise a first interlocking member located on the driven member and a second interlocking member located on the body and which is retained by the first interlocking member, wherein the interlocking members are arranged to guide tilting movement of the body relative to the base about a tilt axis, different from the oscillation axis, between a untilted position and a tilted position.

In a third aspect, the present invention provides a stand for a fan assembly, the stand comprising a base comprising a user interface for controlling operations of the fan assembly, a body mounted on the base, the body comprising at least one air inlet, an impeller, a motor for driving the impeller to draw an air flow through said at least one air inlet, and an air outlet, a first motorized drive mechanism for oscillating the body relative to the base about a first axis, and a second motorized drive mechanism for moving the body relative to the base about a second axis, different from the first axis, and between an untilted position and a tilted position.

The drive mechanisms preferably comprise a common member, preferably in the form of a gear, for generating a first torque which moves the body about the first axis and a second torque which moves the body about the second axis. The common member is preferably a driven member of the first drive mechanism. Each of the drive mechanisms preferably comprises a respective motor and a respective drive member driven by the motor for engaging this common member of the drive mechanisms. The motor and drive member of the first drive mechanism are preferably connected to the base. The motor and drive member of the second drive mechanism are preferably connected to the body. Preferably, the drive members are each arranged to engage a respective portion of the common member. For example, the drive member of the first drive mechanism may engage a peripheral portion of the common member, whereas the drive member of the second drive mechanism may engage a central portion of the common member. Each portion of the common member preferably comprises a respective set of teeth. The sets of teeth are preferably arranged such that, during operation of the first drive mechanism, the engagement between the drive member of the first drive mechanism and the common member results in the rotation of the common member about the first axis, whereas during operation of the second drive mechanism, the engagement between the drive member of the second drive mechanism and the common member results in the movement of the motor and the drive member of the second drive mechanism about the second axis. Each set of teeth preferably extends about a respective one of the first axis and the second axis. The first axis is preferably substantially orthogonal to the second axis.

In a fourth aspect, the present invention provides a fan assembly comprising a base comprising a user interface for controlling operations of the fan assembly, a body mounted on the base, the body comprising at least one air inlet, an impeller, a motor for driving the impeller to draw an air flow through said at least one air inlet, at least one air outlet, an interior passage for conveying air to said at least one air outlet, the interior passage extending about a bore through which air from outside the fan assembly is drawn by air emitted from said at least one air outlet, a first motorized drive mechanism for oscillating the body relative to the base about a first axis, and a second motorized drive mechanism for moving the body relative to the base about a second axis, different from the first axis, and between an untilted position and a tilted position.

Features described above in connection with the first aspect of the invention are equally applicable to each of the second to fourth aspects of the invention, and vice versa.

BRIEF DESCRIPTION OF THE INVENTION

An embodiment of the present invention will now be described, by way of example only, with reference to the accompanying drawings, in which:

FIG. 7(*b*) is a front sectional view of the base, taken along line A-A in FIG. 6, and FIG. 7(*c*) is a side sectional view of the base, taken along line B-B in FIG. 6;

Figure 9C:
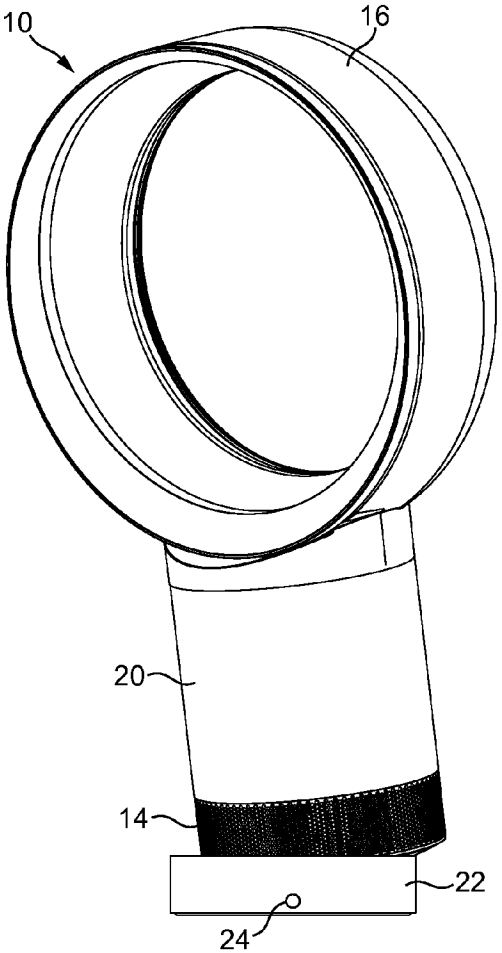
Figure 9B:
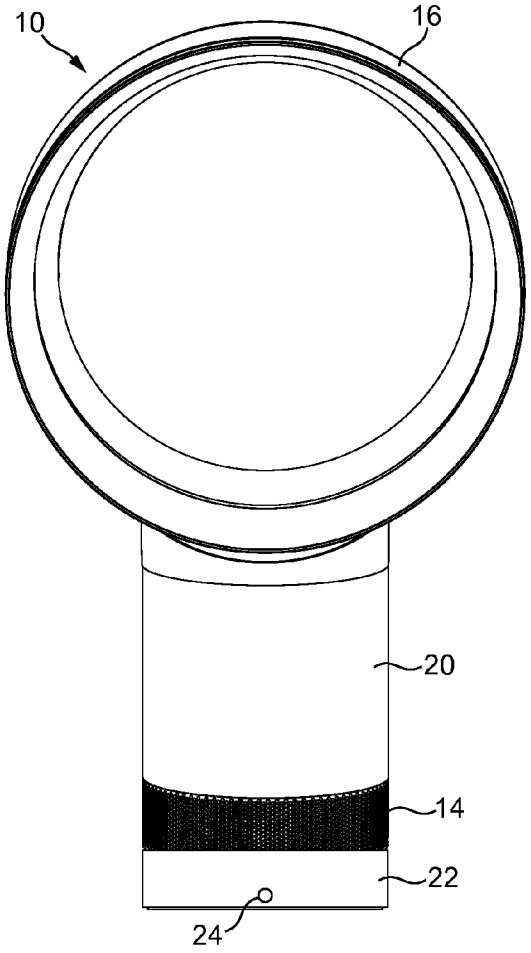
Figure 9A:
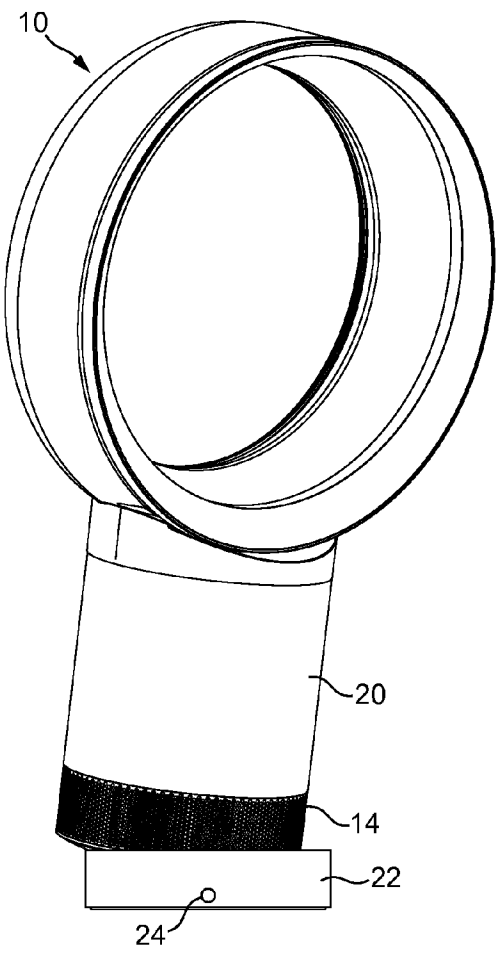
Figure 10:
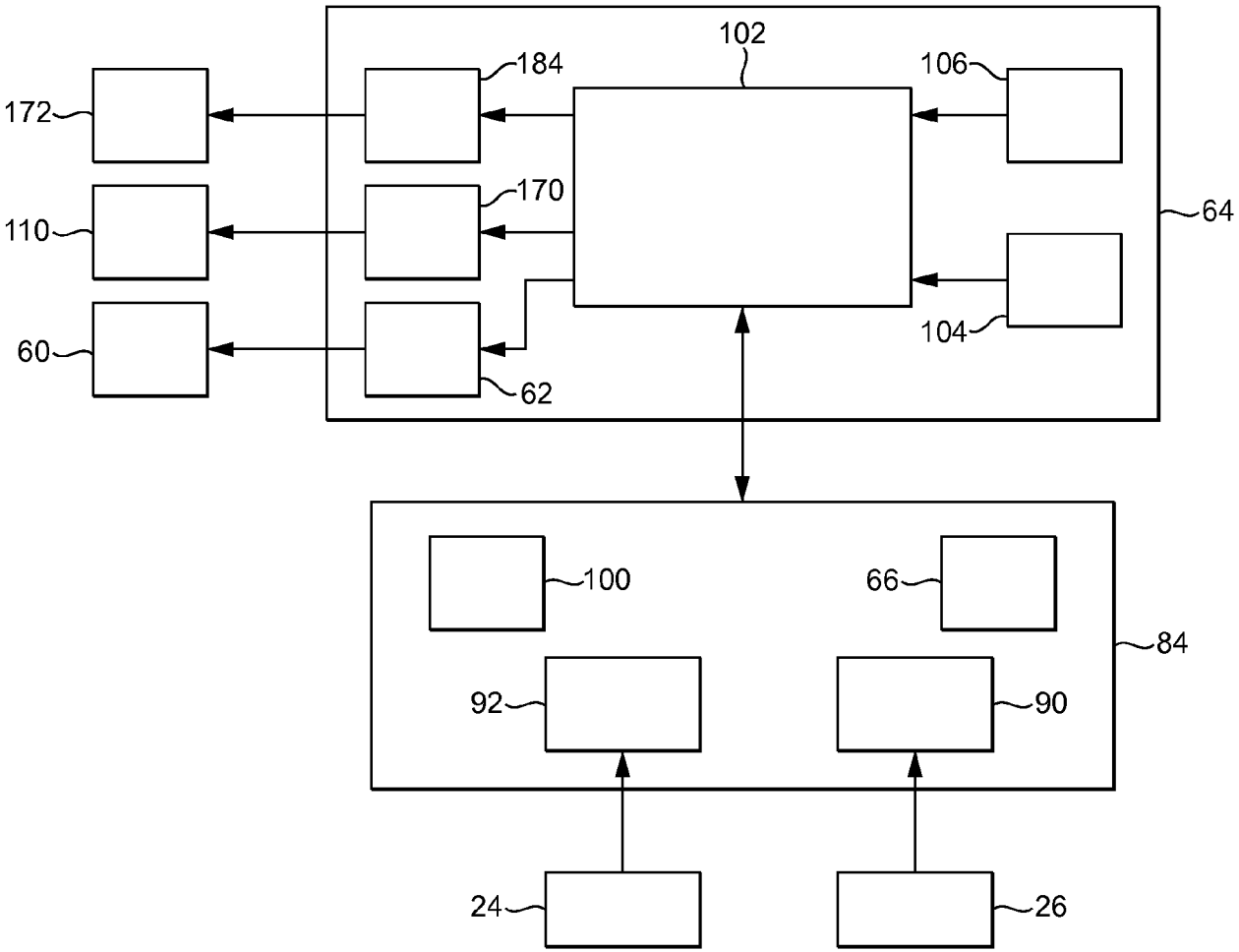

FIGS. 9(*a*), 9(*b*) and 9(*c*) are front views of the fan assembly at different stages during a cycle of oscillating movement of the body relative to the base, with the body in the second fully tilted position relative to the base; and FIG. 10 is a schematic illustration of components of a user interface circuit and a control circuit of the fan assembly.

DETAILED DESCRIPTION OF THE INVENTION

Figure 1:
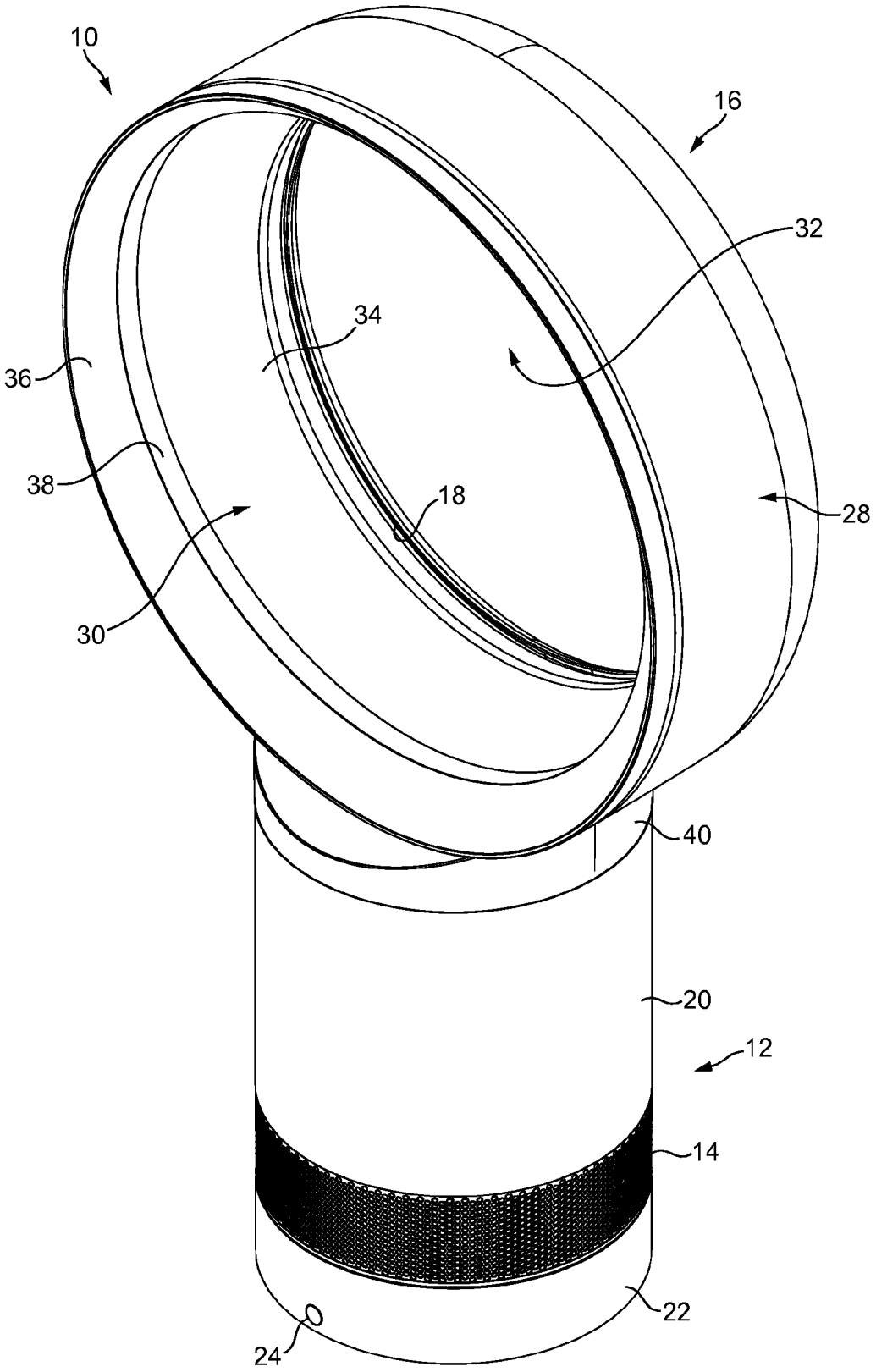
FIG. 1 is a front perspective view of a fan assembly.

FIG. 1 is an external view of a fan assembly 10. The fan assembly 10 comprises a stand 12 having an air inlet 14 in the form of a plurality of apertures formed in an outer casing of the stand 12, and through which a primary air flow is drawn into the stand 12 from the external environment. An annular nozzle 16 having an air outlet 18 for emitting the primary air flow from the fan assembly 10 is connected to the upper end of the stand 12.

The stand 12 comprises a body 20 and a base 22. As described in more detail below, the body 20 is moveable relative to the base 22. The body 20 may be both oscillated relative to the base 22 about a first, oscillation axis A, and titled relative to the base about a second, tilt axis B. In this example, the oscillation axis A is substantially orthogonal to the tilt axis B, and is substantially collinear with the longitudinal axis of the stand 12.

The base 22 comprises a user-operable actuator 24 for allowing a user to control an operational state of the fan assembly 10. The fan assembly 10 also includes a remote control 26 (illustrated schematically in FIG. 10) for allowing the user to control, remotely from the fan assembly 10, operational states and settings of the fan assembly 10. When not in use, the remote control 26 may be stored on the upper surface of the nozzle 16.

Figure 2A:
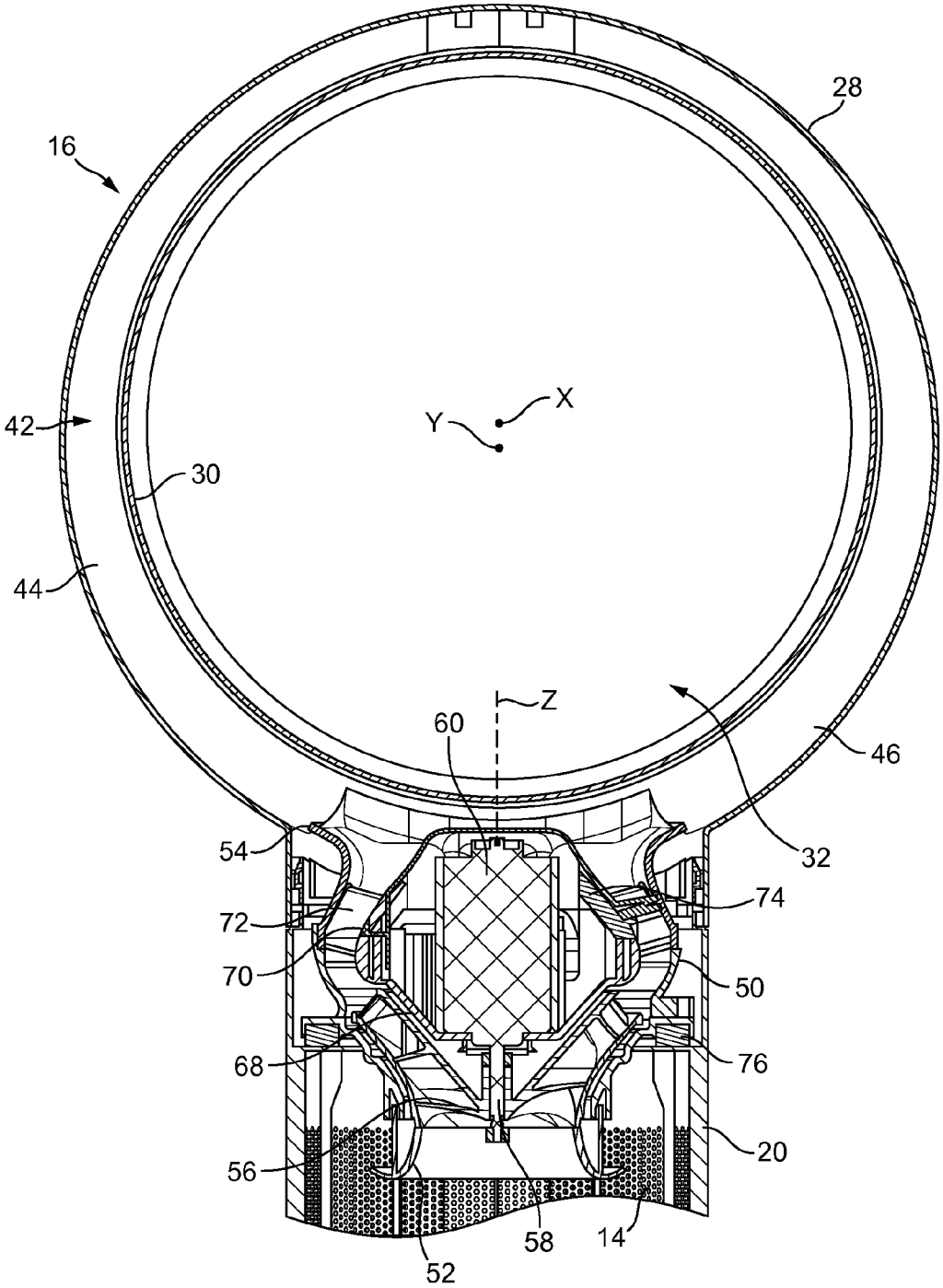
FIG. 2(*a*) is a front sectional view through the nozzle and part of the body of the fan assembly, and FIG. 2(*b*) is a side sectional view through the nozzle and part of the body of the fan assembly.
Figure 2B:
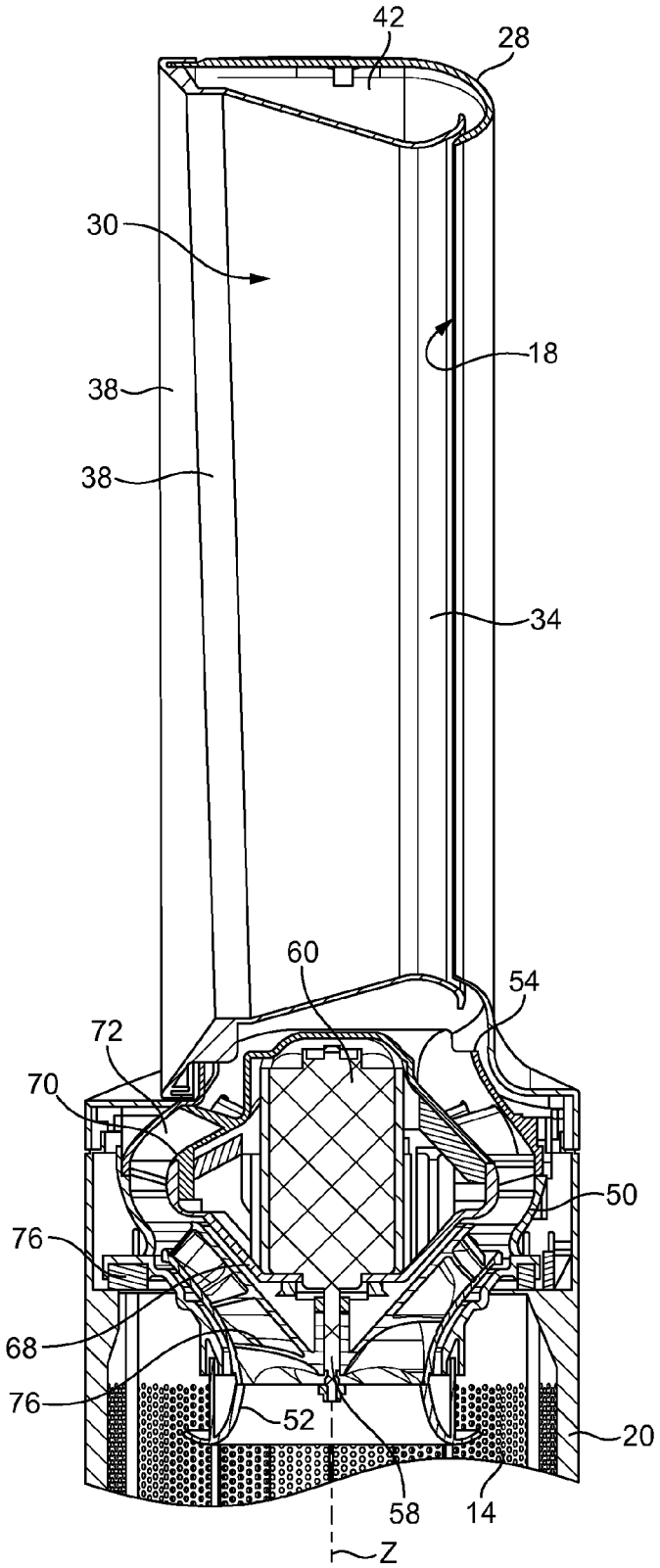
Figure 3:
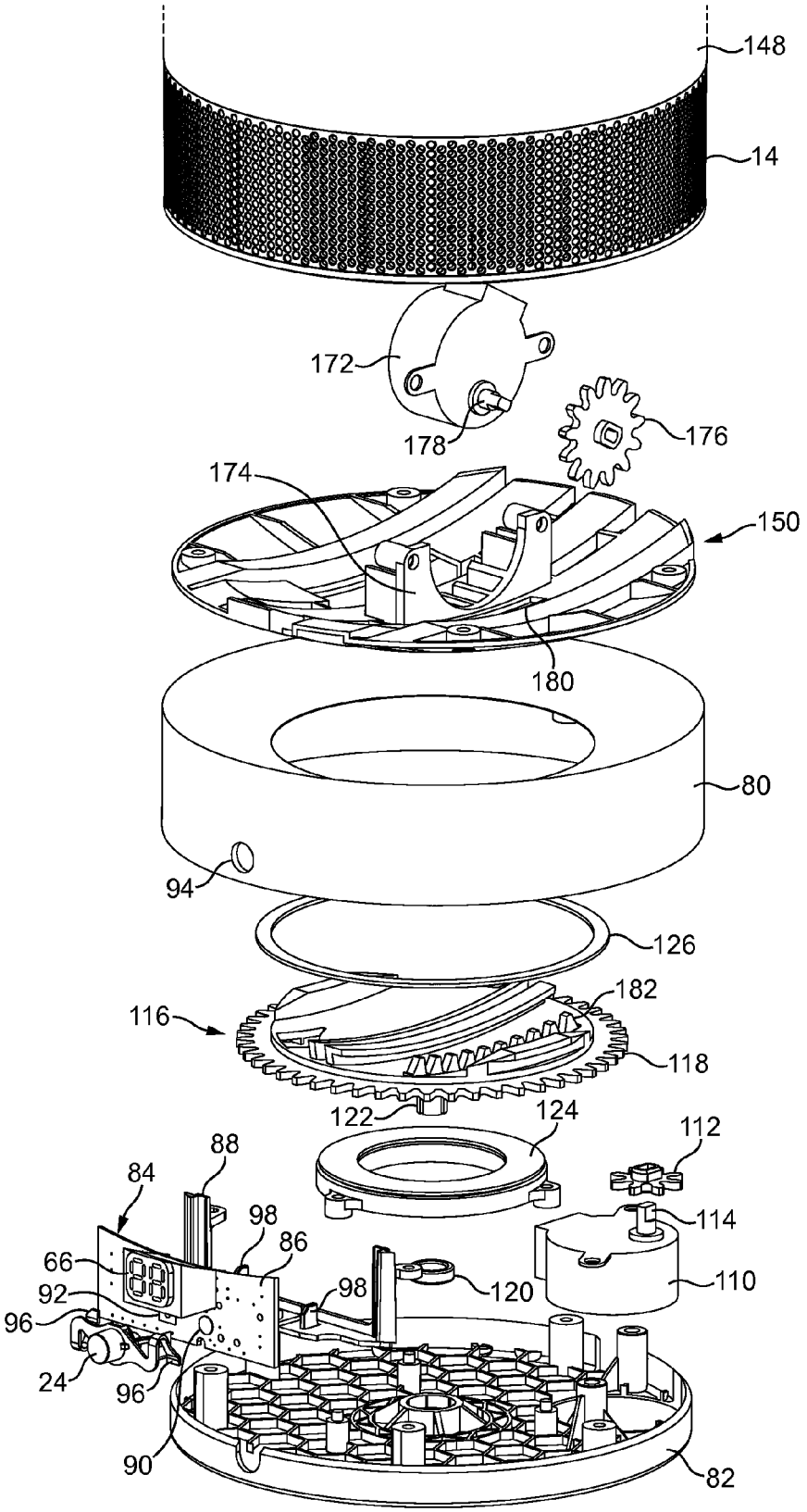
FIG. 3 is an exploded view of the base of the fan assembly and motorized mechanisms for moving the body relative to the base.

The nozzle 16 has an annular shape. With reference also to FIGS. 2(*a*) and 2(*b*), the nozzle 16 comprises an outer wall 28 extending about an annular inner wall 30. In this example, each of the walls 28, 30 is formed from a separate component. Each of the walls 28, 30 has a front end and a rear end. The rear end of the outer wall 28 curves inwardly towards the rear end of the inner wall 30 to define a rear end of the nozzle 16. The front end of the inner wall 30 is folded outwardly towards the front end of the outer wall 28 to define a front end of the nozzle 16. The front end of the outer wall 28 is inserted into a slot located at the front end of the inner wall 30, and is connected to the inner wall 30 using an adhesive introduced to the slot.

The inner wall 30 extends about an axis, or longitudinal axis, X to define a bore, or opening, 32 of the nozzle 16. The bore 32 has a generally circular cross-section which varies in diameter along the axis X from the rear end of the nozzle 16 to the front end of the nozzle 16.

The inner wall 30 is shaped so that the external surface of the inner wall 30, that is, the surface that defines the bore 32, has a number of sections. The external surface of the inner wall 30 has a convex rear section 34, an outwardly flared frusto-conical front section 36 and a cylindrical section 38 located between the rear section 34 and the front section 36.

The outer wall 28 comprises a base 40 which is connected to an open upper end of the body 20, and which has an open lower end which provides an air inlet for receiving the primary air flow from the body 20. The majority of the outer wall 28 is generally cylindrical in shape. The outer wall 28 extends about a central axis, or longitudinal axis, Y which is parallel to, but spaced from, the axis X. In other words, the outer wall 28 and the inner wall 30 are eccentric. In this example, the axis X is located above the axis Y, with each of the axes X, Y being located in a plane which extends vertically through the centre of the fan assembly 10.

The rear end of the outer wall 28 is shaped to overlap the rear end of the inner wall 30 to define the air outlet 18 of the nozzle 16 between the inner surface of the outer wall 28 and the outer surface of the inner wall 30. The air outlet 18 is in the form of a generally circular slot centred on, and extending about, the axis X. The width of the slot is preferably substantially constant about the axis X, and is in the range from 0.5 to 5 mm. The overlapping portions of the outer wall 28 and the inner wall 30 are substantially parallel, and are arranged to direct air over the convex rear section 34 of the inner wall 30, which provides a Coanda surface of the nozzle 16.

The outer wall 28 and the inner wall 30 define an interior passage 42 for conveying air to the air outlet 18. The interior passage 42 extends about the bore 32 of the nozzle 16. In view of the eccentricity of the walls 28, 30 of the nozzle 16, the cross-sectional area of the interior passage 42 varies about the bore 32. The interior passage 42 may be considered to comprise first and second curved sections 44, 46 which each extend in opposite angular directions about the bore 32. Each curved section 44, 46 of the interior passage 42 has a cross-sectional area which decreases in size about the bore 32.

Figure 8C:
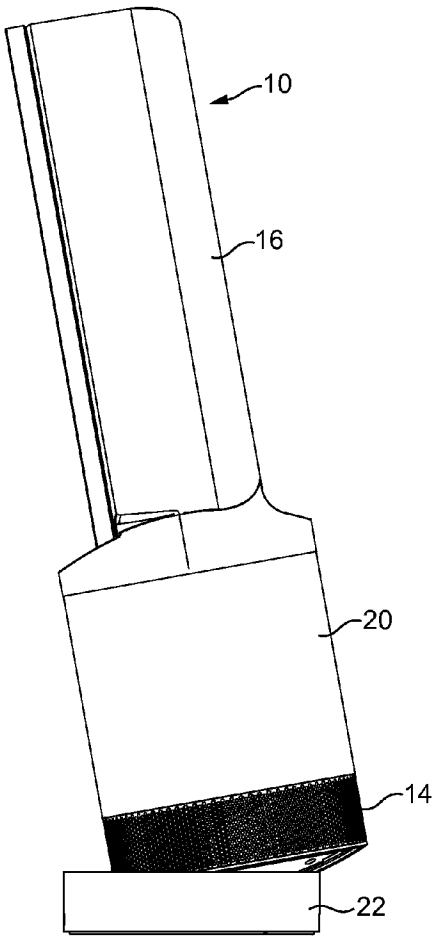
FIG. 8(*a*) is a side view of the fan assembly with the body in an untilted position relative to the base, FIG. 8(*b*) is a side view of the fan assembly with the body in a first fully tilted position relative to the base, and FIG. 8(*c*) is a side view of the fan assembly with the body in a second fully tilted position relative to the base.
Figure 8B:
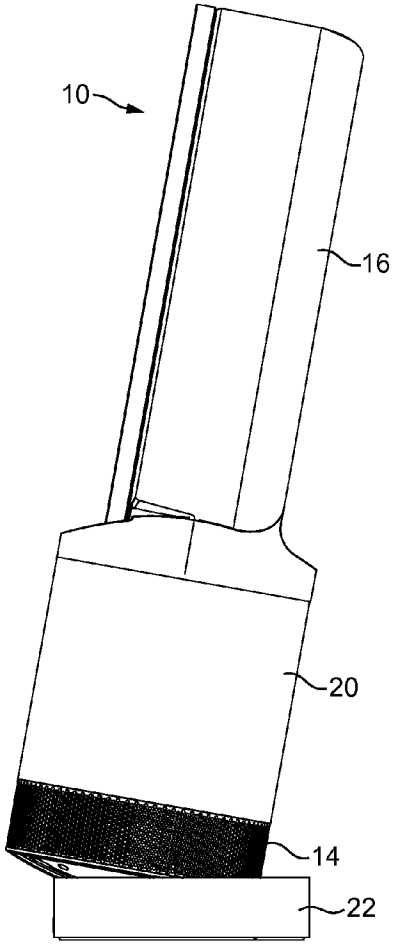
Figure 8A:
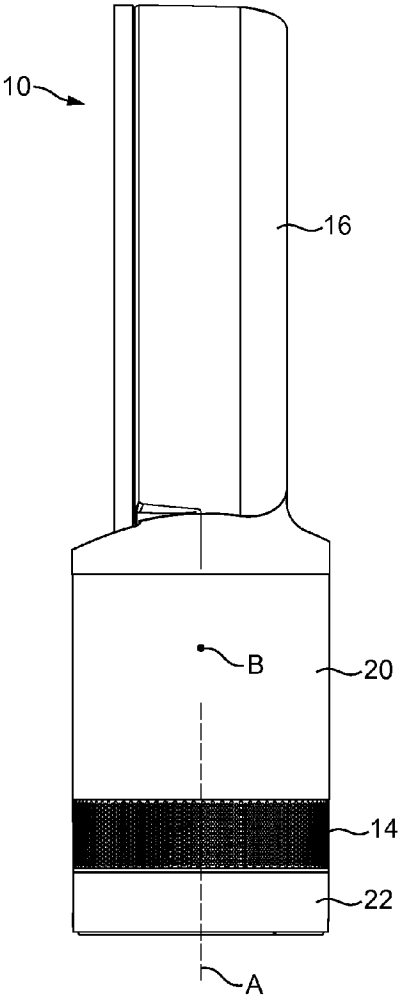

The body 20 and the base 22 are preferably formed from plastics material. The body 20 and the base 22 preferably have substantially the same external diameter so that the external surface of the body 20 is substantially flush with the external surface of the base 22 when the body 20 is in an untilted position relative to the base 22, as illustrated in FIG. 8(*a*). In this example, the body 20 and the base 22 each have a substantially cylindrical side wall.

The body 20 comprises the air inlet 14 through which the primary air flow enters the fan assembly 10. In this example the air inlet 14 comprises an array of apertures formed in an outer casing of the body 20. Alternatively, the air inlet 14 may comprise one or more grilles or meshes mounted within windows formed in the outer casing of the body 20. The body 20 is open at the upper end (as illustrated) for connection to the base 40 of the nozzle 16, and to allow the primary air flow to be conveyed from the body 20 to the nozzle 16.

The body 20 comprises a duct 50 having a first end defining an air inlet 52 of the duct 50 and a second end located opposite to the first end and defining an air outlet 54 of the duct 50. The duct 50 is aligned within the body 20 so that the longitudinal axis of the duct 50 is collinear with the longitudinal axis of the body 20, and so that the air inlet 52 is located beneath the air outlet 54. The air outlet 54 provides the air outlet of the body 20, and so in turn provides the air outlet of the stand 12 from which air is conveyed to the nozzle 16 of the fan assembly 10.

The duct 50 extends about an impeller 56 for drawing the primary air flow into the body 20 of the fan assembly 10. The impeller 56 is a mixed flow impeller. The impeller 56 comprises a generally conical hub, a plurality of impeller blades connected to the hub, and a generally frusto-conical shroud connected to the blades so as to surround the hub and the blades. The blades are preferably integral with the hub, which is preferably formed from plastics material.

The impeller 56 is connected to a rotary shaft 58 extending outwardly from a motor 60 for driving the impeller 56 to rotate about a rotational axis Z. The rotational axis Z is collinear with the longitudinal axis of the duct 50 and orthogonal to the axes X, Y. In this example, the motor 60 is a DC brushless motor having a speed which is variable by a brushless DC motor driver 62 of a main control circuit 64 of the fan assembly 10. The main control circuit 64 is illustrated schematically in FIG. 10. As described in more detail below, the user may adjust the speed of the motor 60 using the actuator 24 or the remote control 26. In this example, the user is able to select one of ten different speed settings, each corresponding to a respective rotational speed of the motor 60. The number of the current speed setting is displayed on a display 66 as the speed setting is changed by the user.

The motor 60 is housed within a motor housing. The outer wall of the duct 50 surrounds the motor housing, which provides an inner wall of the duct 50. The walls of the duct 50 thus define an annular air flow path which extends through the duct 50. The motor housing comprises a lower section 68 which supports the motor 60, and an upper section 70 connected to the lower section 68. The shaft 58 protrudes through an aperture formed in the lower section 68 of the motor housing to allow the impeller 56 to be connected to the shaft 58. The motor 60 is inserted into the lower section 68 of the motor housing before the upper section 70 is connected to the lower section 68. The lower section 68 of the motor housing is generally frusto-conical in shape, and tapers inwardly in a direction extending towards the air inlet 52 of the duct 50. The upper section 70 of the motor housing is generally frusto-conical in shape, and tapers inwardly towards the air outlet 54 of the duct 50. An annular diffuser 72 is located between the outer wall of the duct 50 and the upper section 70 of the motor housing. The diffuser 72 comprises a plurality of blades for guiding the air flow towards the air outlet 54 of the duct 50. The shape of the blades is such that the air flow is also straightened as it passes through the diffuser 72. A cable for conveying electrical power to the motor 60 passes through the outer wall of the duct 50, the diffuser 72 and the upper section 70 of the motor housing. The upper section 70 of the motor housing is perforated, and the inner surface of the upper section 70 of the motor housing is lined with noise absorbing material 74, preferably an acoustic foam material, to suppress broadband noise generated during operation of the fan assembly 10.

The duct 50 is mounted on an annular seat located within the body 20. The seat extends radially inwardly from the inner surface of the outer casing of the body 20 so that an upper surface of the seat is substantially orthogonal to the rotational axis Z of the impeller 56. An annular seal 76 is located between the duct 50 and the seat. The annular seal 76 is preferably a foam annular seal, and is preferably formed from a closed cell foam material. The annular seal 76 has a lower surface which is in sealing engagement with the upper surface of the seat, and an upper surface which is in sealing engagement with the duct 50. The seat comprises an aperture to enable a cable (not shown) to pass to the motor 60. The annular seal 76 is shaped to define a recess to accommodate part of the cable. One or more grommets or other sealing members may be provided about the cable to inhibit the leakage of air through the aperture, and between the recess and the internal surface of the side wall of the body 20.

With reference now to FIGS. 3 to 7, the base 22 comprises an annular outer housing 80 and a circular base plate 82 fixedly connected to the outer housing 80. The base houses a user interface circuit 84. The user interface circuit 84 comprises a number of components which are mounted on a printed circuit board 86. The printed circuit board 86 is held in a frame 88 connected to the base plate 82 of the base 22. The user interface circuit 84 comprises a sensor or receiver 90 for receiving signals transmitted by the remote control 26. In this example, the signals emitted by the remote control 26 are infrared light signals. The remote control 26 is similar to the remote control described in WO 2011/055134, the contents of which are incorporated herein by reference. In overview, the remote control 26 comprises a plurality of buttons which are depressible by the user, and a control unit for generating and transmitting infrared light signals in response to depression of one of the buttons. The infrared light signals are emitted from a window located at one end of the remote control 26. The control unit is powered by a battery located within a battery housing of the remote control 26.

The user interface circuit 84 also comprises a switch 92 which is actuable by a user through operation of the actuator 24. In this example, the actuator 24 is in the form of a push button actuator which has a front surface can be pressed by a user to cause a rear surface of the actuator 24 to contact the switch 92. The front surface of the actuator 24 is accessible through an aperture 94 formed in the outer housing 80 of the base 22. The actuator 24 is biased away from the switch 92 so that, when a user releases the actuator 24, the rear surface of the actuator 24 moves away from the switch 92 to break the contact between the actuator 24 and the switch 92. In this example, the actuator 24 comprises a pair of resilient arms 96. The end of each arm 96 is located adjacent to a respective wall 98 of the frame 88. When a user presses the actuator 24 towards the switch 92, the engagement between the ends of the arms 96 and the walls 98 causes the arms 96 to deform elastically. When the user releases the actuator 24, the arms 96 relax so that the actuator 24 moves automatically away from the switch 92.

The actuator 24 also performs the function of transferring to the receiver 90 light signals which have been transmitted by the remote control 26 and which are incident upon the front surface of the actuator 24. In this example, the actuator 24 is a single moulded component which is formed from light transmissive material, for example a polycarbonate material. A second rear surface of the actuator 24 is located adjacent to the receiver 90, and so part of the actuator 24 which extends between the front surface and this second rear surface provides a path for the transmitted infrared light signals.

The user interface circuit 84 further comprises the display 66 for displaying a current operational setting of the fan assembly 10, and a light emitting diode (LED) 100 (illustrated schematically in FIG. 10) which is activated depending on a current operational state of the fan assembly 10. The display 66 is preferably located immediately behind a relatively thin portion of the housing 80 of the base 22 so that the display 66 is visible to the user through the housing 80 of the base 22. In this example, the LED 100 is activated when the fan assembly 10 is in an "on" state, in which an air flow is generated by the fan assembly 10. In this example, the actuator 24 is also arranged to transfer light emitted by the LED 100 to the front surface of the actuator 24. The actuator 24 may have a third rear surface which is located adjacent to the LED 100, and so part of the actuator 24 which extends between the front surface and this third rear surface provides a path for the light signals emitted by the LED 100. Alternatively, when activated the LED 100 may be visible to the user through the housing 80 of the base 22.

The base 22 also houses the main control circuit 64, not shown in FIGS. 3 to 7 but illustrated schematically in FIG. 10, connected to the user interface circuit 84. The main control circuit 64 comprises a microprocessor 102, a power supply unit 104 connected to a mains power cable for supplying electrical power to the fan assembly 10, and a supply voltage sensing circuit 106 for detecting the magnitude of the supply voltage. The microprocessor 102 controls the motor driver 62 for driving the motor 60 to rotate the impeller 56 to draw a primary air flow into the fan assembly 10 through the air inlet 14.

To operate the fan assembly 10 the user either presses the actuator 24 to actuate the switch 92, or presses an "on/off" button of the remote control 26 to transmit an infrared light signal which passes through the actuator 24 to be received by the receiver 90 of the user interface circuit 84. The user interface circuit 84 communicates this action to the main control circuit 64, in response to which the main control circuit 64 starts to operate the motor 60. The LED 100 is activated. The main control circuit 64 selects the rotational speed of the motor 60 from a range of values, as listed below. Each value is associated with a respective one of the user selectable speed settings.

| Speed setting | Motor speed (rpm) |
|---|---|
| 10 | 9000 |
| 9 | 8530 |
| 8 | 8065 |
| 7 | 7600 |
| 6 | 7135 |
| 5 | 6670 |
| 4 | 6200 |
| 3 | 5735 |
| 2 | 5265 |
| 1 | 4800 |

Initially, the speed setting which is selected by the main control circuit 64 corresponds to the speed setting which had been selected by the user when the fan assembly 10 was previously switched off. For example, if the user has selected speed setting 7, the motor 60 is rotated at 7,600 rpm, and the number "7" is displayed on the display 66.

The motor 60 rotates the impeller 56 causes a primary air flow to enter the body 20 through the air inlet 14, and to pass to the air inlet 52 of the duct 50. The air flow passes through the duct 50 and is guided by the shaped peripheral surface of the air outlet 54 of the duct 50 into the interior passage 42 of the nozzle 16. Within the interior passage 42, the primary air flow is divided into two air streams which pass in opposite angular directions around the bore 32 of the nozzle 16, each within a respective section 44, 46 of the interior passage 42. As the air streams pass through the interior passage 42, air is emitted through the air outlet 18. The emission of the primary air flow from the air outlet 18 causes a secondary air flow to be generated by the entrainment of air from the external environment, specifically from the region around the nozzle 16. This secondary air flow combines with the primary air flow to produce a combined, or total, air flow, or air current, projected forward from the nozzle 16.

If the user has used the remote control 26 to switch on the fan assembly 10, then the user may change the rotational speed of the motor 60 by pressing either a "speed up" button on the remote control 26, or a "speed down" button on the remote control 26. If the user presses the "speed up" button, the remote control 26 transmits a unique infrared control signal which is received by the receiver 90 of the user interface circuit 84. The user interface circuit 84 communicates the receipt of this signal to the main control circuit 64, in response to which the main control circuit 64 increases the rotational speed of the motor 60 to the speed associated with the next highest speed setting, and instructs the user interface circuit 84 to display that speed setting on the display 66. If the user presses the "speed down" button of the remote control 26, the remote control 26 transmits a different, unique infrared control signal which is received by the receiver 90 of the user interface circuit 84. The user interface circuit 84 communicates the receipt of this signal to the main control circuit 64, in response to which the main control circuit 64 decreases the rotational speed of the motor 60 to the speed associated with the next lowest speed setting, and instructs the user interface circuit 84 to display that speed setting on the display 66.

The user may switch off the fan assembly 10 by pressing the "on/off" button of the remote control 26. The remote control 26 transmits an infrared control signal which is received by the receiver 90 of the user interface circuit 84. The user interface circuit 84 communicates the receipt of this signal to the main control circuit 64, in response to which the main control circuit 64 de-activates the motor 60 and the LED 100. The user may also switch off the fan assembly 10 by pressing the actuator 24 against the switch 92.

As mentioned above, the body 20 may be both oscillated relative to the base 22 about a first, oscillation axis A, and titled relative to the base 22 about a second, tilt axis B. These axes are identified in FIG. 8(*a*). The oscillation axis A is substantially collinear with the rotational axis Z of the impeller 56, whereas the tilt axis B is substantially orthogonal to the oscillation axis A and the axes X, Y.

The base 22 houses a motorized oscillation mechanism for oscillating the body 20 relative to the base 22 about the oscillation axis A. The oscillation mechanism comprises a motor 110, which is preferably in the form of a stepper motor. The motor 110 is connected to the base plate 82 of the base 22 so that the motor 110 remains in a fixed position relative to the base 22 during the oscillating movement of the body 20 relative to the base 22. The motor 110 is arranged to drive a gear train. The gear train comprises a drive gear 112 connected to a rotary shaft 114 protruding from the motor 110, and a driven gear 116 which is driven by the drive gear 112 to rotate about the oscillation axis A. Each of the drive gear 112 and the driven gear 116 is preferably in the form of a spur gear, with the drive gear 112 rotating about an axis which is parallel to, but spaced from, the oscillation axis A. The drive gear 112 has a set of teeth which mesh with a set of teeth 118 provided on a peripheral portion of the driven gear 116 to rotate the driven gear 116 about the oscillation axis A. In this example, the gear ratio of the gear train is around 6.6:1. Bearings are provided within the base 22 for supporting the driven gear 116 for rotation relative to the base 22. These bearings included lower bearing 120, which engages a shaft 122 of the driven gear 116, and a thrust bearing 124 mounted on the base plate 82 for supporting the lower surface (as illustrated) of the driven gear 116. An annular plain bearing 126 may be mounted on the upper surface of the set of teeth 118 to ensure that the driven gear 116 continues to rotate relative to the base 82 in the event of any contact between the upper surface of the driven gear 116 and the housing 80 of the base 22.

The body 20 of the stand 12 is mounted on the driven gear 116 for rotation therewith. The driven gear 116 comprises a plurality of first interlocking members which each co-operate with a respective second interlocking member located on the body 20 to retain the body 20 on the driven gear 116. The interlocking members also serve to guide tilting movement of the body 20 relative to the driven gear 116, and thus relative to the base 22, so that there is substantially no twisting or rotation of the body 20 relative to the base 22 as it is moved from or to a tilted position.

Figure 4A:
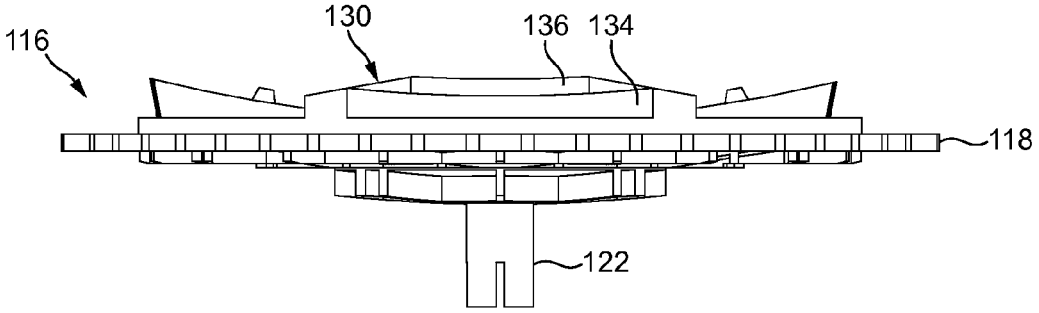
FIG. 4(*a*) is a side view of a gear of the motorized mechanisms, and FIG. 4(*b*) is a perspective view, from above, of the gear.
Figure 4B:
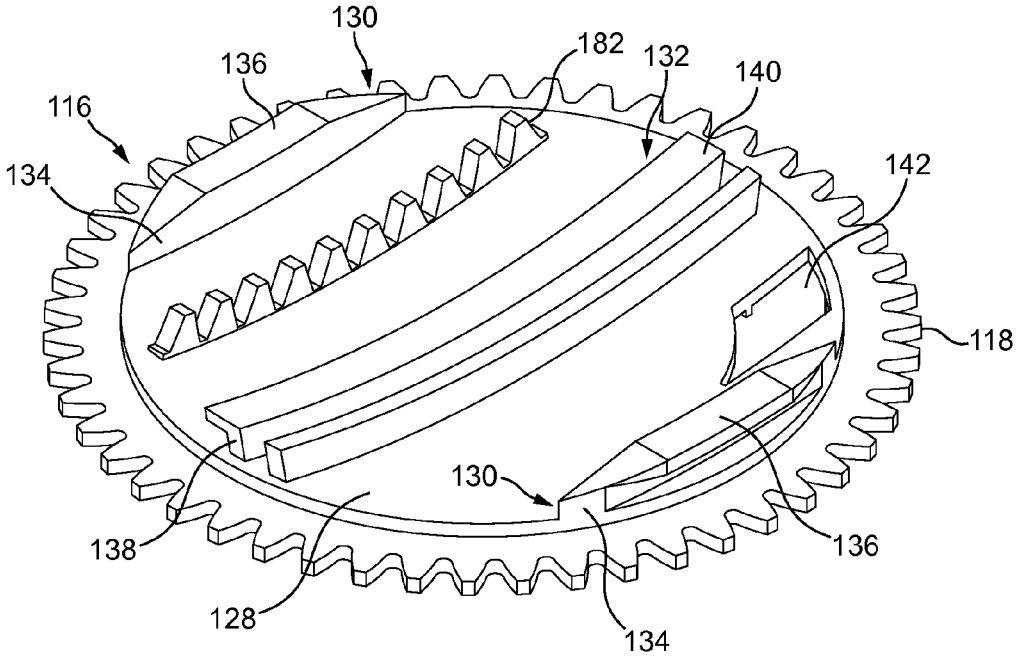
Figure 5A:
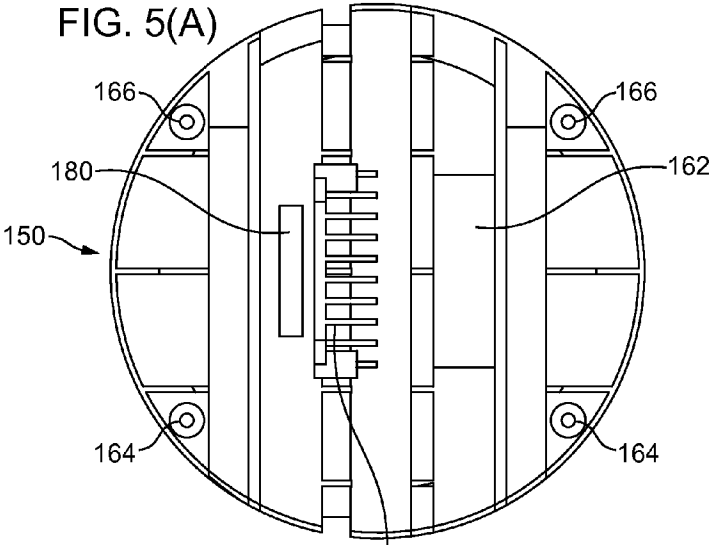
FIG. 5(*a*) is a top view of a tilt plate of the body, FIG. 5(*b*) is a perspective view, from below, of the tilt plate, FIG. 5(*c*) is a perspective view, from above, of the tilt plate, and FIG. 5(*d*) is a rear view of the tilt plate.
Figure 5B:
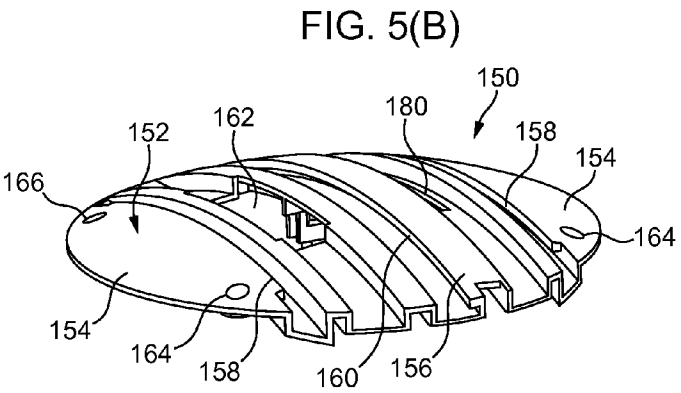
Figure 5C:
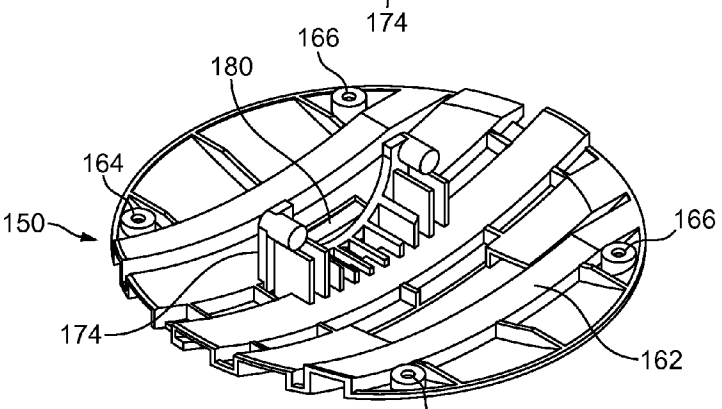
Figure 5D:
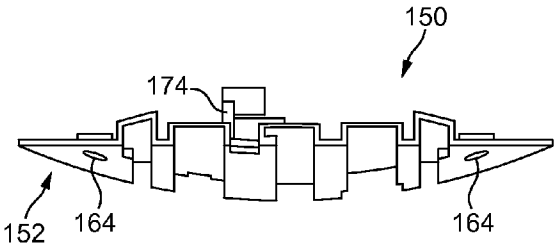
Figure 6:
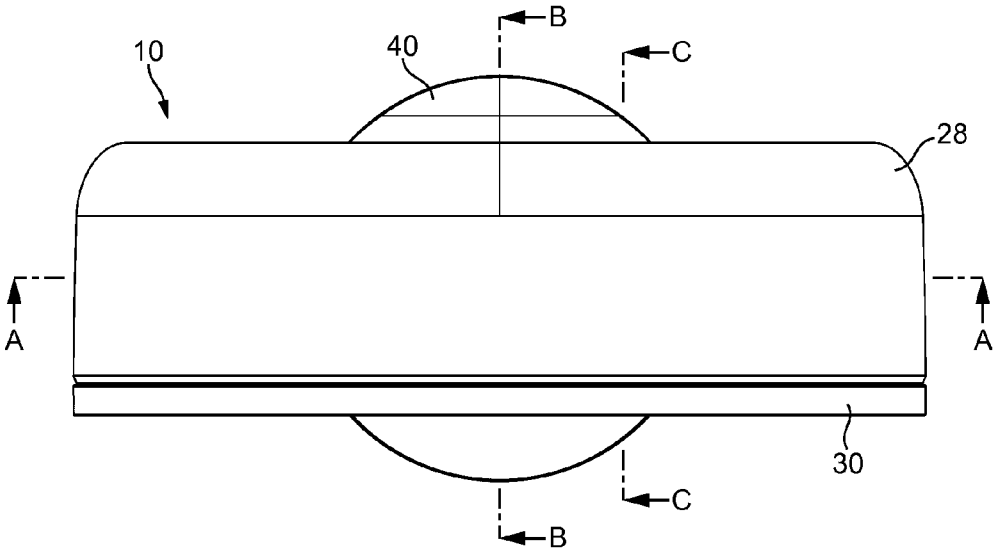
FIG. 6 is a top view of the fan assembly.

With reference to FIGS. 4(*a*) and 4(*b*), each of the first interlocking members extends in the direction of movement of the body 20 relative to the base 22. The first interlocking members are connected to, and are preferably integral with, a concave upper surface 128 of the driven gear 116. In this embodiment, the driven gear 116 comprises two, relatively short, outer interlocking members 130, and a single, relatively long inner interlocking member 132 located between the outer interlocking members 130. Each of the outer interlocking members 130 has a cross-section in the form of an inverted L-shape. Each of the outer interlocking members 130 comprises a wall 134 which is connected to, and upstanding from, the upper surface of the driven gear 116, and a curved flange 136 which connected to, and orthogonal to, the upper end of the wall 134. The inner interlocking member 132 also has a cross-section in the form of an inverted L-shape. The inner interlocking member 132 comprises a wall 138 which is connected to, and upstanding from, the upper surface of the driven gear 116, and a curved flange 140 which connected to, and orthogonal to, the upper end of the wall 138. The driven gear 116 also includes an aperture 142 for allowing a cable to pass from the main control circuit 64 to the motor 60.

The body 20 comprises a substantially cylindrical outer casing 148 and a convex tilt plate 150 connected to the lower end of the outer casing 148. The tilt plate 150 is illustrated in isolation from the outer casing 148 in FIGS. 5(*a*) to 5(*d*). The lower surface 152 of the tilt plate 150 is convex in shape, and has a curvature which is substantially the same as that of the upper surface 128 of the driven gear 116. The tilt plate 150 comprises a plurality of second interlocking members which are each retained by a respective first interlocking member of the driven gear 116 to connect the body 20 to the driven gear 116. The tilt plate 150 comprises a plurality of parallel grooves which define a plurality of curved rails of the tilt plate 150. The grooves define a pair of outer rails 154 and an inner rail 156, and these rails 154, 156 provide the second interlocking members of the body 20. Each of the outer rails 154 comprises a flange 158 which extends into a respective groove of the tilt plate 150, and which has a curvature which is substantially the same as the curvature of the flanges 136 of the driven gear 116. The inner rail 156 also comprises a flange 160 which extends into a respective groove of the tilt plate 150, and which has a curvature which is substantially the same as the curvature of the flange 140 of the driven gear 116. An aperture 162 is formed in the tilt plate 150 allows the cable to pass through the tilt plate 150 to the motor 60.

Figure 7A:
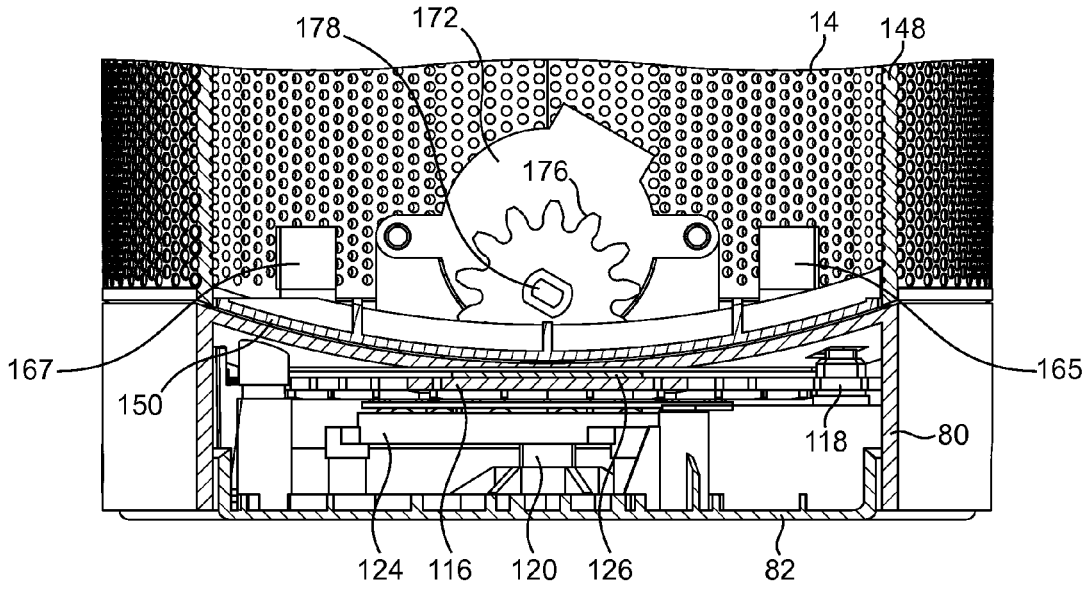
FIG. 7(*a*) is a side sectional view of the base, taken through line C-C in FIG. 6.
Figure 7B:
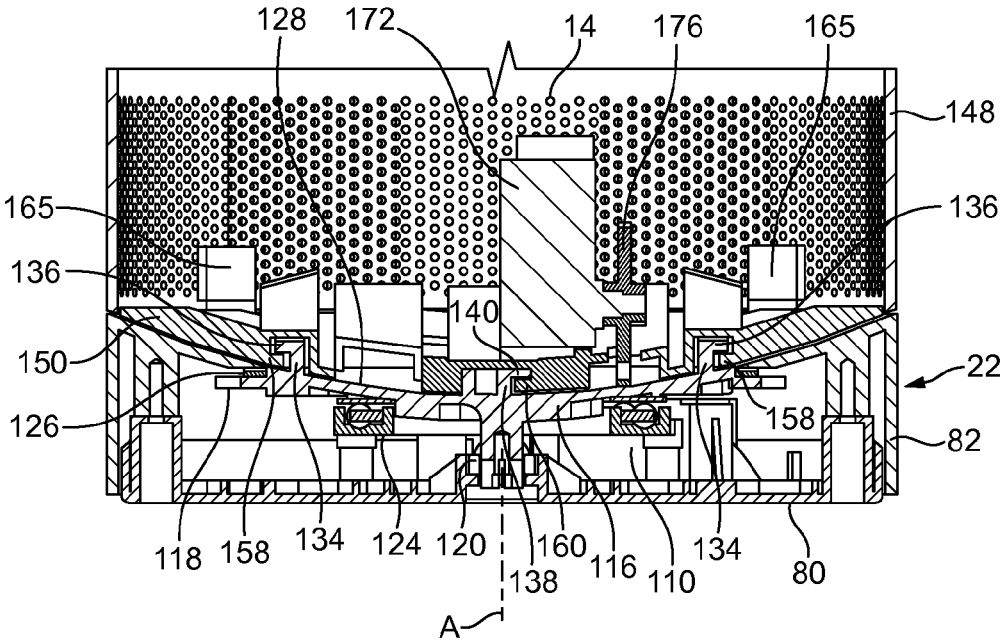
Figure 7C:
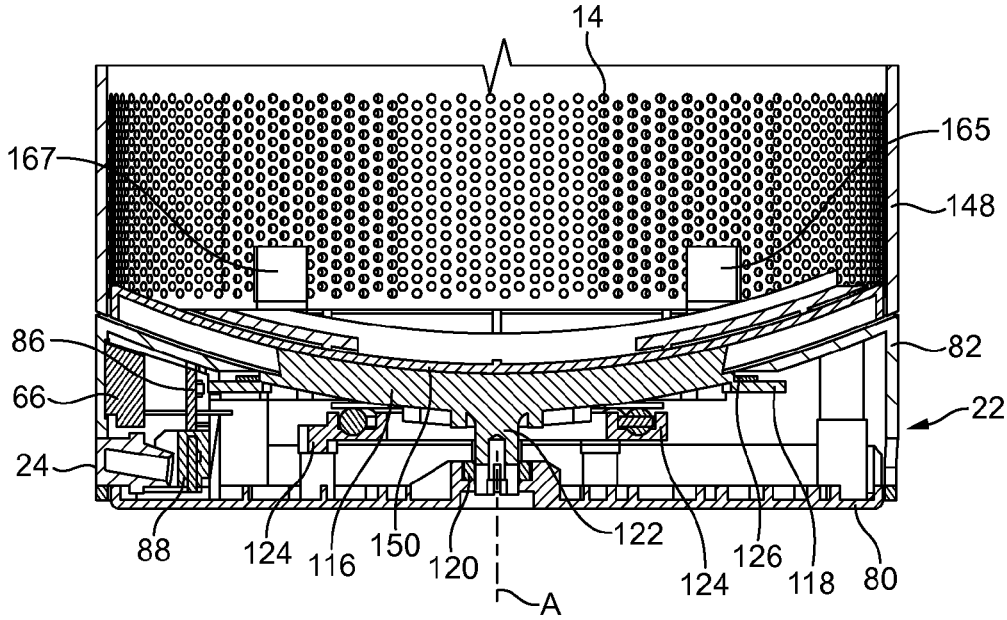

The stand 12 may be arranged so that the body 20 is moveable manually relative to the base 22 about the tilt axis B. In this case, to connect the body 20 to the driven gear 116 the tilt plate 150 is inverted from the orientation illustrated in FIG. 5(*a*). The cable is fed through the apertures 142, 162, and the tilt plate 150 is then slid over the driven gear 116 so that the flange 158 of each outer rail 128 is located beneath a respective flange 136 of the driven gear 116, and so that the flange 160 of the inner rail 156 is located beneath the flange 140 of the driven gear 116, as illustrated in FIG. 7(*b*). With the tilt plate 150 positioned centrally on the driven gear 116, the outer casing 148 of the body 20 is lowered on to the tilt plate 150. The body 20 and the base 22 are then inverted, and the body 20 is tilted relative to the driven gear 116 to reveal a first plurality of apertures 164 located on the tilt plate 150. Each of these apertures 164 is aligned with a respective tubular protrusion 165 (indicated in FIG. 7(*b*)) on the outer casing 148 of the body 20. A self-tapping screw is screwed into each of the apertures 164 to enter the underlying protrusion 165, thereby partially connecting the tilt plate 150 to the outer casing 148. The body 20 is then tilted in the reverse direction to reveal a second plurality of apertures 166 located on the tilt plate 150. Each of these apertures 166 is also aligned with a tubular protrusion 167 (one of which is shown in FIG. 7(*a*) and FIG. 7(*c*)) on the outer casing 148 of the body 20. A self-tapping screw is screwed into each of the apertures 166 to enter the underlying protrusion 167 to complete the connection of the tilt plate 150 to the outer casing 148.

The main control circuit 64 comprises oscillation motor control circuitry 170 for driving the motor 110 of the oscillation mechanism. The operation of the oscillating mechanism is controlled by the main control circuit 64 upon receipt of an appropriate control signal from the remote control 26. The main control circuit 64 may be configured to control the motor 110 to oscillate the body 20 relative to the base 22 in one or more pre-defined oscillation patterns which may be selected by the user through depressing a respective button of the remote control 26. In these oscillation patterns, the motor 110 is driven alternatively in forwards and reverse directions to oscillate the body 20 relative to the base 22. The motor 110 may be driven to rotate the body 20 at either a set speed or at a variable speed during an oscillation cycle. For example, the body 20 may be oscillated relative to the base at a speed which varies in a sinusoidal manner during an oscillation cycle. Alternatively, or additionally, the oscillation speed may be varied during an oscillation cycle using the remote control 26. During each oscillation cycle, the body 20 may be rotated about the oscillation axis A by an angle in the range from 0 to 360°, preferably by an angle in the range from 60 to 240°. Each oscillation cycle may have a respective different oscillation angle, such as 90°, 120° and 180°. For example, in the oscillation pattern illustrated in FIGS. 9(*a*) to 9(*c*) the main control circuit 64 is arranged to oscillate the body 20 relative to the base 22 about an angle of around 90°, and to perform around 3 to 5 oscillation cycles per minute.

As mentioned above, the stand 12 may be arranged so that the body 20 is moveable manually relative to the base 22 about the tilt axis B. However, in the illustrated embodiment the stand 12 comprises a motorized drive mechanism for driving the movement of the body 20 relative to the base 22 about the tilt axis B. The drive mechanism comprises a motor 172, which is preferably in the form of a stepper motor. The motor 172 is connected to the body 20 so that the motor 172 remains in a fixed position relative to the body 20 during the tilting movement of the body 20 relative to the base 22. In this embodiment, the motor 172 is mounted on the tilt plate 150. The motor 172 is connected to a motor mount 174 which is attached to, and preferably integral with, the upper surface of the tilt plate 150. The motor 172 is arranged to drive a drive gear 176 which is connected to a rotary shaft 178 protruding from the motor 172. The drive gear 176 is preferably in the form of a spur gear, which is driven by the motor 172 to rotate about an axis which is parallel to, but spaced from, the tilt axis B.

The drive gear 176 is arranged to engage the driven gear 116 of the motorized oscillation mechanism. An aperture 180 is formed in the tilt plate 150, through which the drive gear 176 protrudes to engage the driven gear 116. The drive gear 176 engages the driven gear 116 of the oscillation mechanism in such a manner that the motor 172 and the drive gear 176 move relative to the driven gear 116 about the tilt axis B upon actuation of the drive mechanism, and so cause the body 20 to move relative to the base 22 about the tilt axis B. The driven gear 116 comprises a second set of teeth 182 for engaging with teeth of the drive gear 176. This second set of teeth 182 is located on a central portion of the upper surface of the driven gear 116, and extends about the tilt axis B. The second set of teeth 182 is aligned such that the engagement with the rotating drive gear 176 generates substantially no movement of the driven gear 116 about the oscillation axis A, and so torque is transferred by the driven gear 116 to the drive gear 176 to cause the motor 172 and the drive gear 176 move relative to the driven gear 116 about the tilt axis B. The driven gear 116 of the oscillation mechanism thus provides part of the gear train of the drive mechanism. In this example, the gear ratio of the gear train of the drive mechanism is around 11.7:1.

The main control circuit 64 comprises drive motor control circuitry 184 for driving the motor 172 of the drive mechanism, and so a cable extends from the main control circuit 64, located in the base 22, to the motor 172, located in the body 20. This cable also passes through the apertures 142, 162 formed in the driven gear 116 and the tilt plate 150. During assembly, the motor 172 and the drive gear 176 are connected to the tilt plate 150 before the tilt plate 150 is connected to the driven gear 116. The operation of the drive mechanism is controlled by the main control circuit 64 upon receipt of an appropriate control signal from the remote control 26. For example, the remote control 26 may comprise buttons for driving the motor 172 in opposite directions to move the body 20 from an untilted position relative to the base 22, as illustrated in FIG. 8(*a*), towards a selected one of a first fully tilted position relative to the base, as illustrated in FIG. 8(*b*), and a second fully tilted position relative to the base, as illustrated in FIG. 8(*c*), and then subsequently to any position between these two fully tilted positions. The body may be moved about the tilt axis by an angle in the range from −20 to 20°, preferably by an angle in the range from −10 to 10°.

The main control circuit 64 may be configured to control the motor 172 to tilt the body 20 relative to the base 22 in one or more pre-defined tilting patterns which may be selected by the user through depressing a respective button of the remote control 26. In these tilting patterns, the motor 110 is driven alternatively in forwards and reverse directions to oscillate the body 20 relative to the base 22 about the tilt axis B, and between the two fully tilted positions. The motor 172 may be driven to tilt the body 20 at either a set speed or at a variable speed during such a tilting cycle.

The main control circuit 64 may be configured to operate the motors 110, 172 simultaneously to promote the distribution of the airflow generated by the fan assembly around a room or other domestic environment. This operational mode of the fan assembly 10 may be actuated by a user through pressing a dedicated one of the buttons of the remote control 26. The main control circuit 64 may be arranged to store a plurality of predefined patterns of movement of the body 20 relative to the base 22, and the user may select a chosen one of these patterns using the remote control 26.

The invention claimed is:

1. A fan assembly comprising:

a base;

a body comprising at least one air inlet, an impeller and a first motor for driving the impeller to draw an air flow through said at least one air inlet;

at least one air outlet;

an interior passage for conveying air to said at least one air outlet, the interior passage extending about a bore through which air from outside the fan assembly is drawn by air emitted from said at least one air outlet;

a motorized oscillation mechanism housed within the base for oscillating the body relative to the base about an oscillation axis, the oscillation mechanism comprising a second motor, a drive member driven by the second motor, and a driven member which is driven by the drive member to rotate relative to the base about the oscillation axis, wherein the body is mounted on the driven member for rotation therewith; and interlocking members for retaining the body on the driven member, the interlocking members being arranged to guide tilting movement of the body relative to the base about a tilt axis, different from the oscillation axis, between a untilted position and a tilted position, wherein a tilting interface between the body and the base is the same as an oscillation interface between the body and the base.

2. The fan assembly of claim 1, wherein the drive member is arranged to engage a peripheral portion of the driven member.

3. The fan assembly of claim 1, wherein each of the drive member and the driven member is in the form of a gear.

4. The fan assembly of claim 1, wherein each of the drive member and the driven member is in the form of a spur gear.

5. The fan assembly of claim 1, wherein each interlocking member comprises a curved flange.

6. The fan assembly of claim 1, comprising a motorized drive mechanism for actuating movement of the body relative to the base about the tilt axis.

7. The fan assembly of claim 1, wherein the base comprises a user interface for controlling operations of the fan assembly.

8. The fan assembly of claim 6, wherein the drive mechanism comprises a third motor, and a second drive member driven by the third motor, and wherein the second drive member engages the driven member.

9. The fan assembly of claim 8, wherein the third motor is connected to the body.

10. The fan assembly of claim 8, wherein the second drive member comprises a gear, and wherein the driven member comprises a set of teeth for engaging with teeth of the second drive member.

11. The fan assembly of claim 9, wherein the body comprises a tilt plate to which the second interlocking member is connected, and wherein the third motor is mounted on the tilt plate.

12. The fan assembly of claim 10, wherein the interlocking members comprise a first interlocking member located on the driven member and a second interlocking member located on the body and which is retained by the first interlocking member.

13. A stand for a fan assembly, the stand comprising:

a base;

a body comprising at least one air inlet, an impeller, a first motor for driving the impeller to draw an air flow through said at least one air inlet, and an air outlet;

a motorized oscillation mechanism housed within the base for oscillating the body relative to the base about an oscillation axis, the oscillation mechanism comprising a second motor, a drive member driven by the second motor, and a driven member which is driven by the drive member to rotate relative to the base about the oscillation axis, wherein the body is mounted on the driven member for rotation therewith; and interlocking members for retaining the body on the driven member, the interlocking members being arranged to guide tilting movement of the body relative to the base about a tilt axis, different from the oscillation axis, between a untilted position and a tilted position, wherein a tilting interface between the body and the base is the same as an oscillation interface between the body and the base.

14. The stand of claim 13, wherein the drive member is arranged to engage a peripheral portion of the driven member.

15. The stand of claim 13, wherein each of the drive member and the driven member is in the form of a gear.

16. The stand of claim 13, wherein each of the drive member and the driven member is in the form of a spur gear.

17. The stand of claim 13, wherein each interlocking member comprises a curved flange.

18. The stand of claim 13, comprising a motorized drive mechanism for actuating movement of the body relative to the base about the tilt axis.

19. The stand of claim 13, wherein the interlocking members comprise a first interlocking member located on the driven member and a second interlocking member located on the body and which is retained by the first interlocking member.

20. The stand of claim 13, wherein the base comprises a user interface for controlling operations of the fan assembly.

21. A fan assembly comprising the stand of claim 13 and a nozzle mounted on the stand, the nozzle comprising an interior passage for receiving an air flow from the air outlet of the body, and at least one air outlet, the interior passage extending about a bore through which air from outside the fan assembly is drawn by air emitted from said at least one air outlet of the nozzle.

22. The stand of claim 18, wherein the drive mechanism comprises a third motor, and a second drive member driven by the third motor, and wherein the second drive member engages the driven member.

23. The stand of claim 22, wherein the third motor is connected to the body.

24. The stand of claim 22, wherein the second drive member comprises a gear, and wherein the driven member comprises a set of teeth for engaging with teeth of the second drive member.

25. The stand of claim 23, wherein the body comprises a tilt plate to which the second interlocking member is connected, and wherein the third motor is mounted on the tilt plate.

26. A stand for a fan assembly, the stand comprising:

a base comprising a user interface for controlling operations of the fan assembly;

a body mounted on the base, the body comprising at least one air inlet, an impeller, a motor for driving the impeller to draw an air flow through said at least one air inlet, and an air outlet;

a first motorized drive mechanism for oscillating the body relative to the base about a first axis; and a second motorized drive mechanism for moving the body relative to the base about a second axis, different from the first axis, and between an untilted position and a tilted position, wherein a tilting interface between the body and the base is the same as an oscillation interface between the body and the base.

27. The stand of claim 26, wherein the drive mechanisms comprise a common member for transmitting to the body a first torque which moves the body about the first axis, and a second torque which moves the body about the second axis.

28. The stand of claim 26, wherein the first axis is substantially orthogonal to the second axis.

29. The stand of claim 27, wherein the common member comprises a gear.

30. The stand of claim 27, wherein the common member is a driven member of the first drive mechanism.

31. The stand of claim 27, wherein the body is mounted on the common member.

32. The stand of claim 27, wherein each of the drive mechanism comprises a respective motor for driving a respective drive member for engaging the common member of the drive mechanisms.

33. The stand of claim 32, wherein the motor and drive member of the first drive mechanism are connected to the base.

34. The stand of claim 32, wherein the motor and drive member of the second drive mechanism are connected to the body.

35. The stand of claim 32, wherein the drive members are each arranged to engage a respective portion of the common member.

36. The stand of claim 35, wherein the drive member of the first drive mechanism engages a peripheral portion of the common member, and the drive member of the second drive mechanism engages a central portion of the common member.

37. The stand of claim 36, wherein each portion of the common member comprises a respective set of teeth.

38. The stand of claim 37, wherein the sets of teeth are arranged such that, during operation of the first drive mechanism, the engagement between the drive member of the first drive mechanism and the common member results in the rotation of the common member about the first axis, whereas during operation of the second drive mechanism, the engagement between the drive member of the second drive mechanism and the common member results in the movement of the motor and the drive member of the second drive mechanism about the second axis.

39. The stand of claim 26, wherein each set of teeth extends about a respective one of the first axis and the second axis.

40. A fan assembly comprising a base comprising a user interface for controlling operations of the fan assembly; a body mounted on the base, the body comprising at least one air inlet, an impeller, a motor for driving the impeller to draw an air flow through said at least one air inlet; at least one air outlet; an interior passage for conveying air to said at least one air outlet, the interior passage extending about a bore through which air from outside the fan assembly is drawn by air emitted from said at least one air outlet; a first motorized drive mechanism for oscillating the body relative to the base about a first axis; and a second motorized drive mechanism for moving the body relative to the base about a second axis, different from the first axis, and between an untilted position and a tilted position, wherein a tilting interface between the body and the base is the same as an oscillation interface between the body and the base.

* * * * *